United States Patent [19]

Bauer et al.

[11] 4,279,230

[45] Jul. 21, 1981

[54] FUEL CONTROL SYSTEMS FOR INTERNAL COMBUSTION ENGINES

[75] Inventors: Philippe Bauer, Marly le Roy; Jean Lamy, Croissy-sur Seine; Bernard Martel, Bagneux, all of France

[73] Assignee: Societe Industrielle de Brevets et D'Etudes S.I.B.E., Neuilly-sur-Seine, France

[21] Appl. No.: 902,243

[22] Filed: May 2, 1978

[30] Foreign Application Priority Data

Dec. 30, 1977 [FR] France ..... 77 39842
May 6, 1977 [GB] United Kingdom ..... 19149/78

[51] Int. Cl.[3] ..... F02G 3/00; F02M 7/00
[52] U.S. Cl. ..... 123/440; 123/489
[58] Field of Search ..... 123/119 EC, 32 EE, 32 EA; 60/276, 285

[56] References Cited

U.S. PATENT DOCUMENTS

| | | | |
|---|---|---|---|
| 3,906,207 | 9/1975 | Rivene et al. | 123/32 EB |
| 3,906,910 | 9/1975 | Szlaga Jr. | 123/119 EC |
| 3,939,654 | 2/1976 | Creps | 60/285 |
| 3,990,411 | 11/1976 | Oberstadt et al. | 123/32 EA |
| 4,009,699 | 3/1977 | Hetzler et al. | 123/32 EB |
| 4,046,118 | 9/1977 | Aono | 123/119 EC |
| 4,075,834 | 2/1978 | Saito et al. | 60/285 |
| 4,103,649 | 8/1978 | Matumoto et al. | 123/119 EL |
| 4,129,105 | 12/1978 | Ito et al. | 123/440 |
| 4,130,095 | 12/1978 | Bowler et al. | 60/285 |
| 4,134,261 | 1/1979 | Itzuka et al. | 60/285 |
| 4,136,645 | 1/1979 | Ito et al. | 123/489 |
| 4,140,084 | 2/1979 | Di Nunzio | 123/119 EC |
| 4,166,437 | 9/1979 | Bianchi et al. | 123/489 |
| 4,170,201 | 10/1979 | Camp et al. | 123/489 |
| 4,176,626 | 12/1979 | Norimatsu et al. | 123/489 |

*Primary Examiner*—Charles J. Myhre
*Assistant Examiner*—R. A. Nelli
*Attorney, Agent, or Firm*—Stevens, Davis, Miller & Mosher

[57] ABSTRACT

A fuel control system comprises a probe in contact with the exhaust gases, a circuit for supplying fuel and air to the engine, having a solenoid valve for metering at least the fuel flow, a closed-loop electronic control circuit connected to the probe and energizing the solenoid valve in dependence on the signal from the probe. The loop is opened responsive to predetermined operating conditions of the engine. Further means control the solenoid valve in dependence on another engine operating parameter during open-loop operation. A memory is provided for storing a value representative of the control of the solenoid valve means during closed-loop operation.

22 Claims, 16 Drawing Figures

FUEL CONTROL SYSTEMS FOR INTERNAL COMBUSTION ENGINES

BACKGROUND AND SUMMARY OF THE INVENTION

The invention relates to a fuel control system for an internal combustion engine having an exhaust conduit, comprising:

- a probe in the exhaust conduit adapted to generate an electrical signal indicative of exhaust conditions,
- at least one circuit for supplying fuel and air to the engine, having solenoid valve means for metering at least the fuel flow rate in said circuit,
- a closed loop electronic control circuit connected to said probe and effective to control said solenoid valve means in dependence of said signal,
- and means for opening the loop responsive to predetermined operating conditions of the engine.

An engine cannot operate satisfactorily on a stoichiometric fuel-air mixture under all conditions. A stoichiometric mixture is satisfactory when the engine is at its normal operating temperature and runs at a constant speed under moderate load; on the other hand the richness must be increased under certain operating conditions, e.g. when the engine runs while cold after starting, when the engine is under full load, or during acceleration.

The enrichment may be obtained by opening the regulation loop so that the device operates in the same manner as a conventional carburation device. However, this approach is far from being fully satisfactory. Upon transition from closed loop to open-loop operation, there is instantaneous loss of the automatic adjustment which is inherent to closed-loop operation. As is known, the optimum richness of the mixture depends on operating parameters which then prevail, inter alia on the engine temperature but also, to a lesser extent, on external factors such as the ambient temperature and atmospheric pressure.

It is an object of the invention to provide a system of the above defined kind wherein the disadvantages resulting from the transition from closed-loop to open-loop operation are at least partially overcome.

According to a first aspect of the invention, the electronic circuit has further means for controlling said solenoid valve means in dependence on at least one further engine operating parameter during open loop operation.

According to another aspect, the electronic circuit has memory means for storing a value representative of the adjustment of the solenoid valve means during closed-loop operation and means for controlling the solenoid valve by adjusting it from the stored value upon opening of said loop.

An acceptable compromise between the somewhat contradictory requirements of easy driving and minimum pollution by the exhaust gases can be achieved with such arrangements.

The electronic circuit is typically of a kind wherein the solenoid valve is controlled by supplying it with periodic rectangular electric signals with a cyclic or aperture ratio which determines the average time during which the solenoid valve is opened during a given time interval. Then upon transition to open-loop operation, enrichment can be brought about by modifying the aperture ratio, starting from the stored value, in accordance with a function depending on an engine operating parameter such as its temperature.

The electronic circuit is e.g. adapted for open-loop operation under the following conditions:

- when the engine temperature is below a first predetermined value,
- during acceleration and under full load when the engine temperature is between the first value and a second predetermined value, and/or
- under full load when the engine temperature is above the second predetermined value.

When the electronic circuit comprises "volatile" memory means, the content of which is last if the supply is cut off, the problem arises of restarting the engine after a stop. This problem can be solved in a number of ways. The memory means can have a separate power supply which remains available even when the engine is stopped. Another solution is to provide the memory means with auxiliary means which sets a reference value (either fixed or adjustable by the driver) for starting under open-loop conditions.

It will generally be advantageous to use on/off valves, in which case the flow rate of fuel supplied to the engine is adjusted by modifying the cyclic or aperture ratio RCO.

Under these conditions, adjustment during transition from closed-loop to open-loop operation (which will always correspond to an increase in the aperture ratio of the solenoid valve) can be made either by increasing the aperture ratio by an amount depending on the engine operating parameter, or by multiplying it by a similarly dependent factor.

During closed-loop operation, the adjustment or setting can be stored to correspond to a predetermined engine load.

Jerky operation can be avoided if the closed-loop regulating circuit is automatically and permanently adjusted to the open-loop regulating circuit when the latter controls operation of the vehicle.

In particular embodiments, the system can comprise a single solenoid valve placed in the main fuel supply circuit (possibly in parallel flow with a permanent flow calibrated orifice). Usually, however, it is preferable to provide at least a second solenoid valve which is actuated simultaneously with the first valve and is placed in the engine idling circuit.

Other valves can be added, inter alia a valve for supplying additional air to the engine.

Currently available solenoid valves are open when not energized. Advantageously, to prevent operation resulting from auto-ignition after the contact has been cut off, a quenching circuit is provided so as to keep the solenoid valves closed for a predetermined time after the contact has been cut.

The invention will be better understood from the following description of carburation systems constituting particular embodiments thereof. The description refers to the accompanying drawings.

SHORT DESCRIPTION OF THE DRAWINGS

Figure 3A:
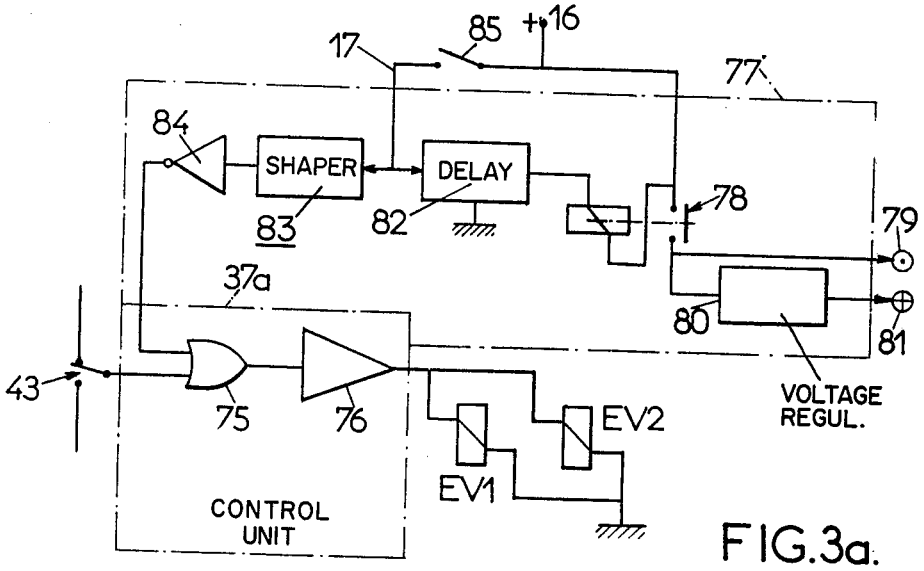
Figure 3:
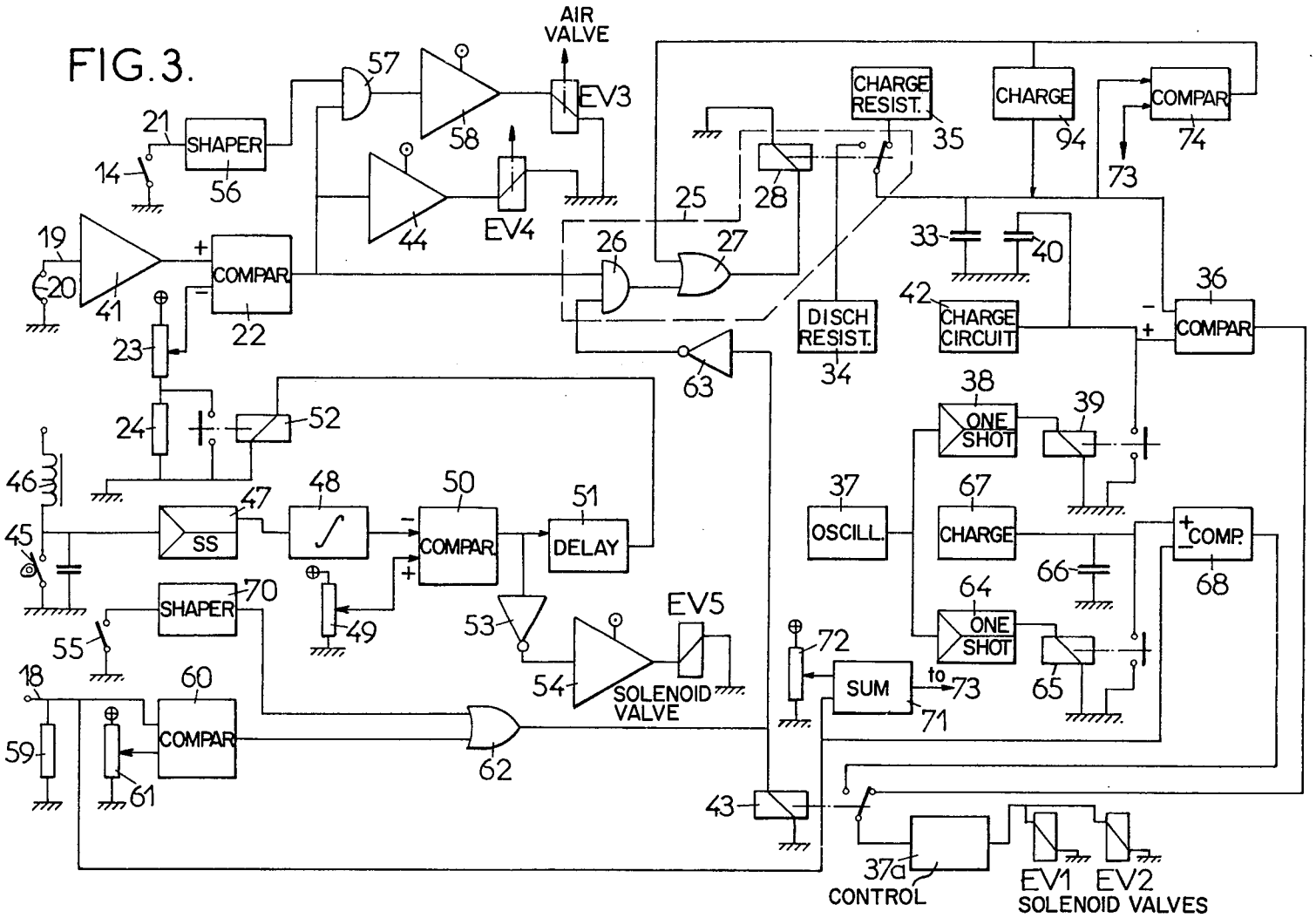
Figure 4A:
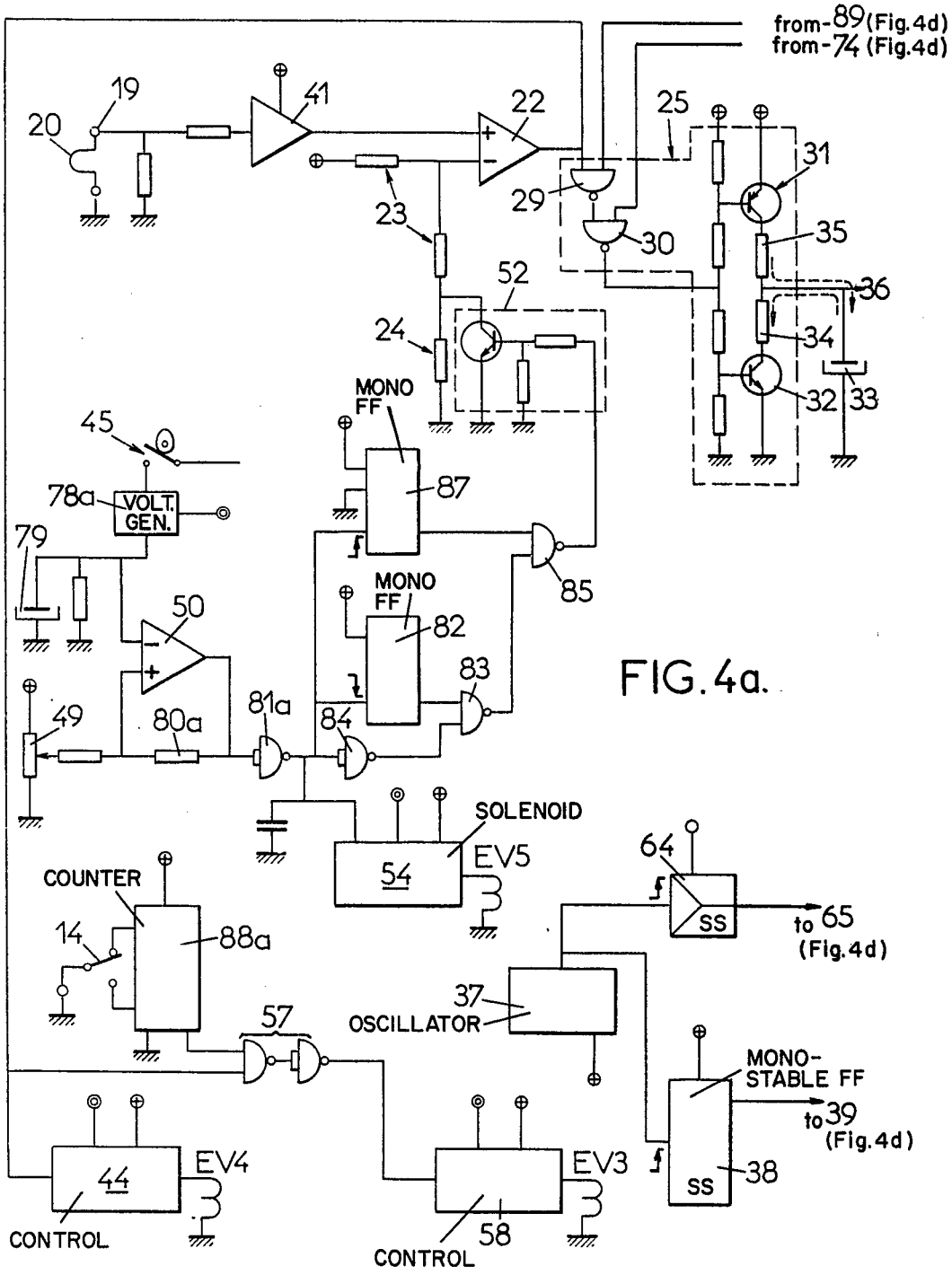
Figure 4B:
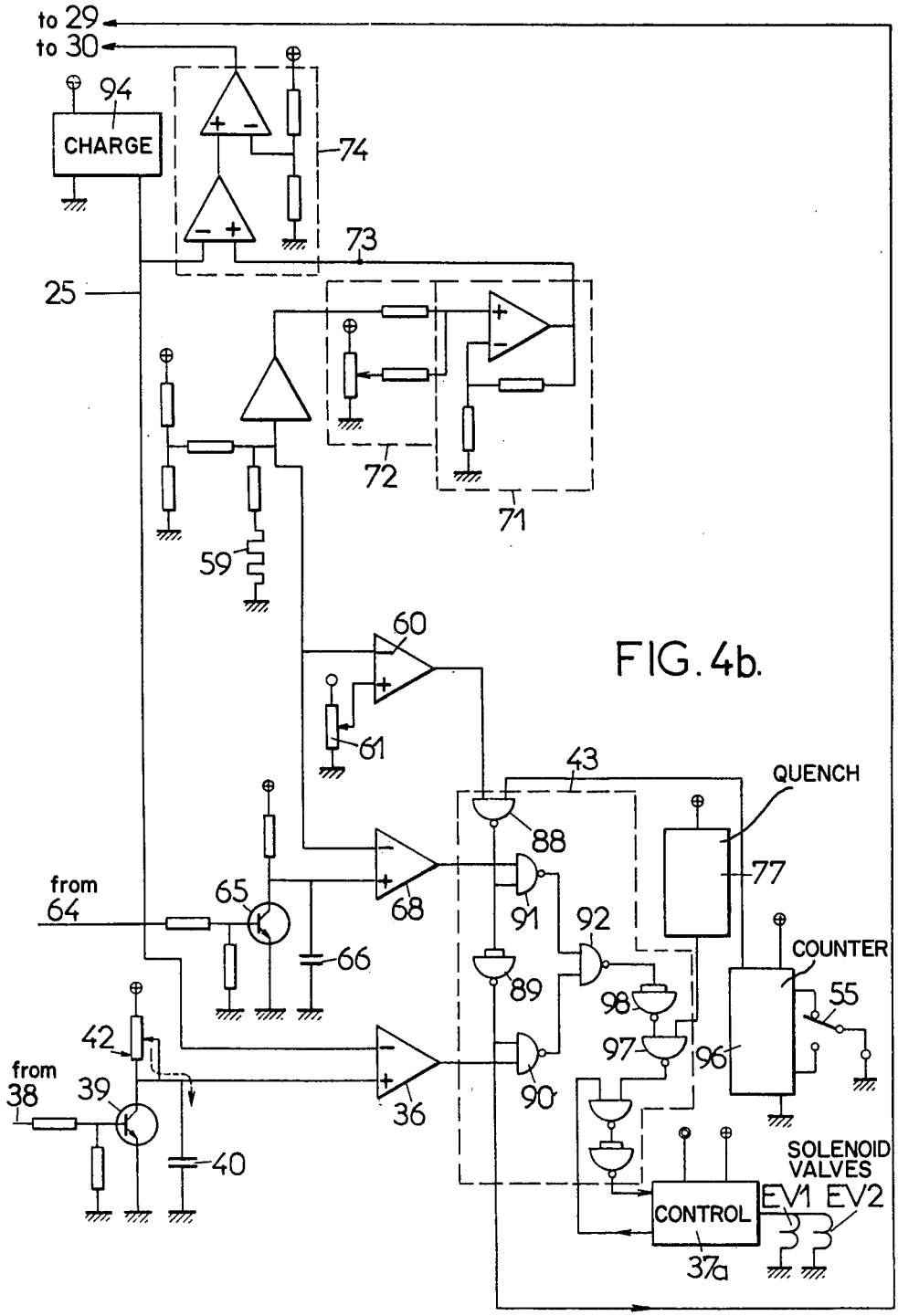
Figure 4C:
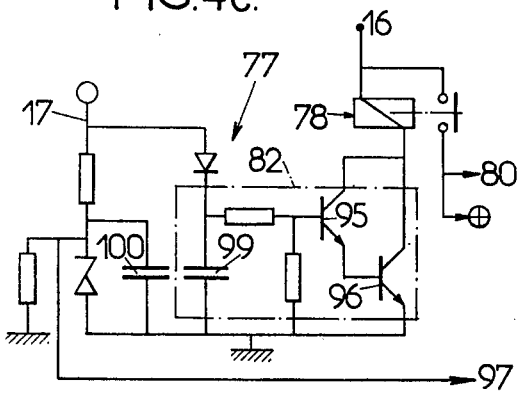
Figure 4D:
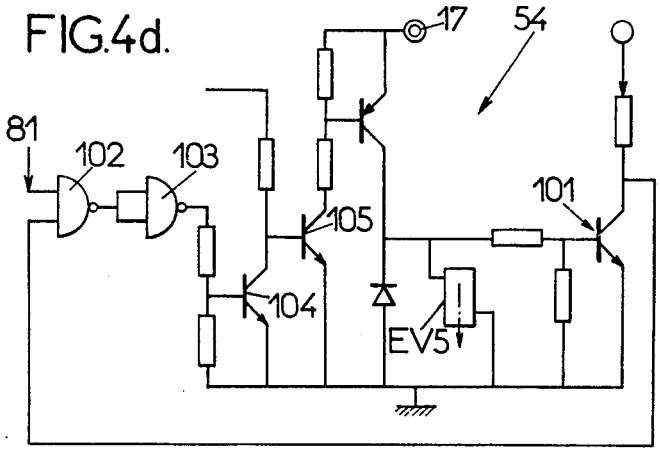

FIG. 3 s a block diagram illustrating the operation of the various components of the electronic circuit according to the first embodiment of the system;

FIG. 3A shows a detail of FIG. 3;

FIGS. 4*a* and 4*b* as a whole are a detailed diagram of an embodiment of part of the components shown in diagrammatic form in FIG. 3, divided into two sections corresponding to the left and right portions of the diagrams;

FIGS. 4*c* and 4*d* show details of FIGS. 4*a* and 4*b;*

Figure 7:
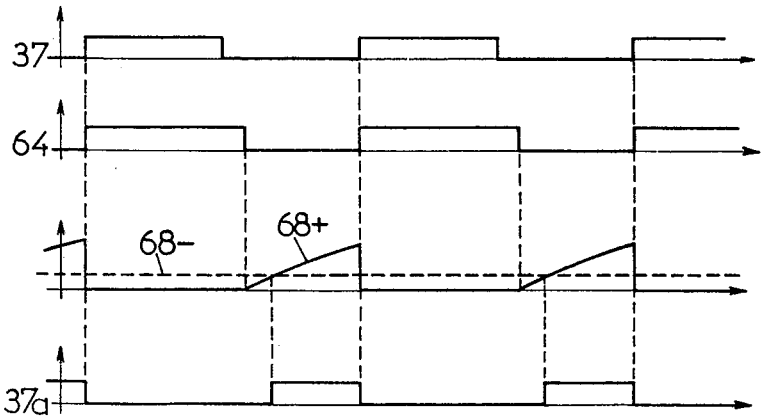
Figure 5:
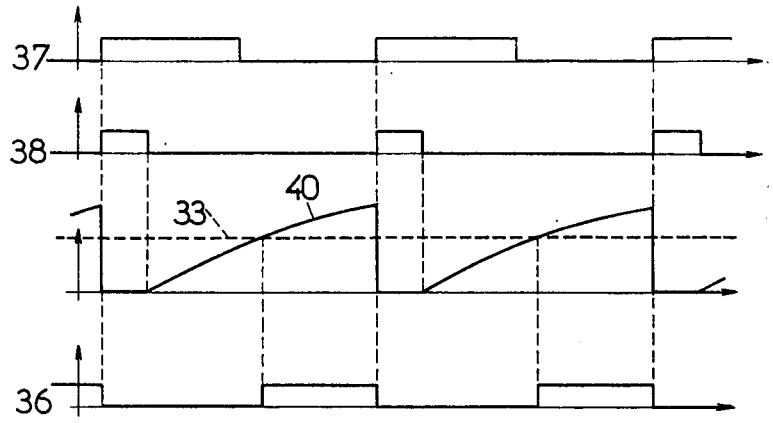
Figure 6:
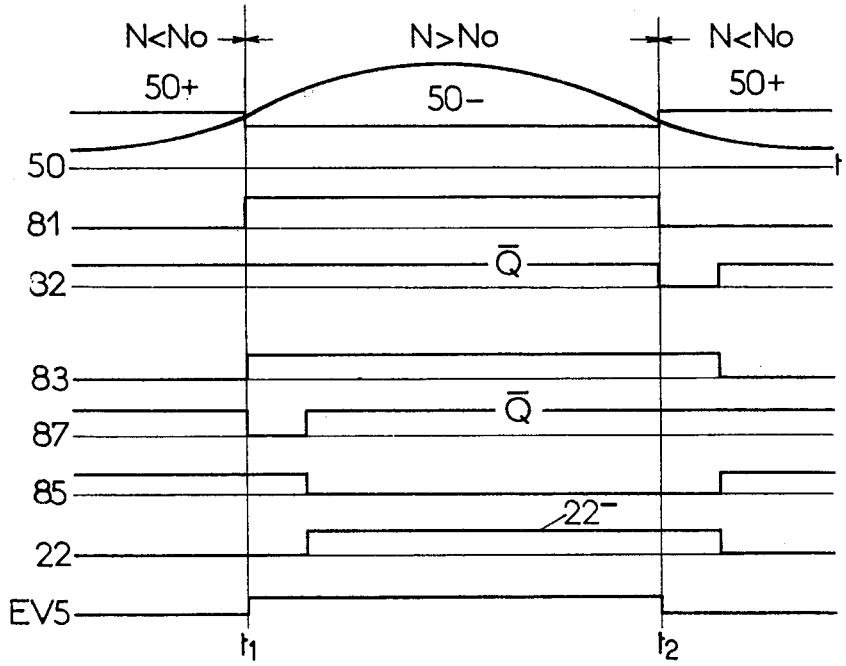
Figure 8:
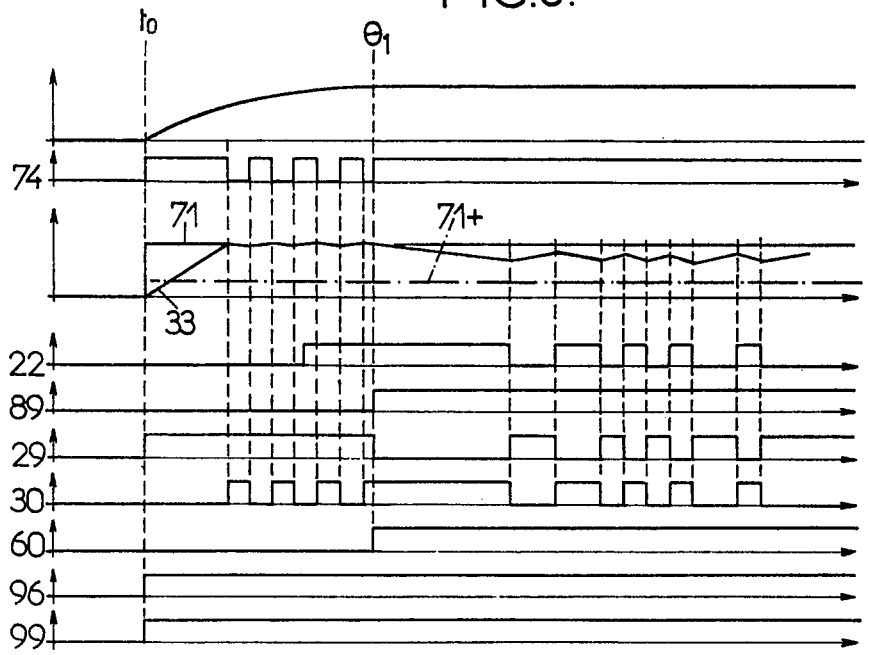
Figure 9:
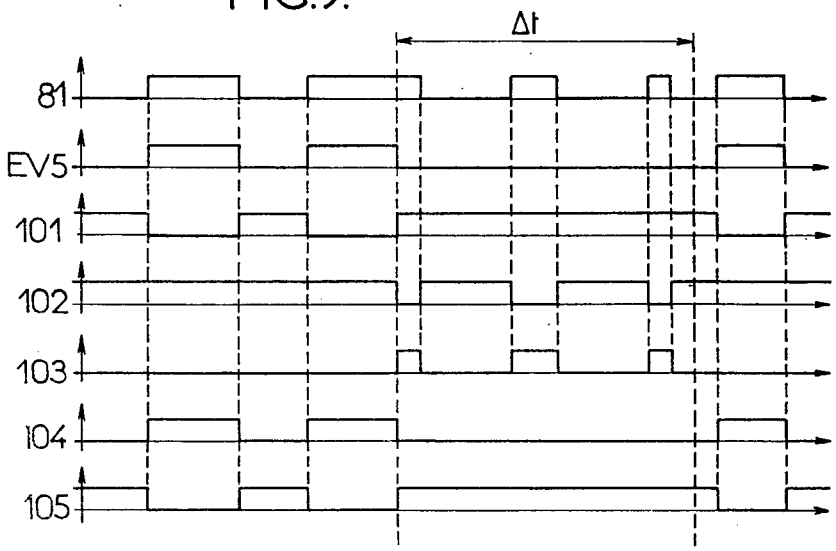
Figure 10:
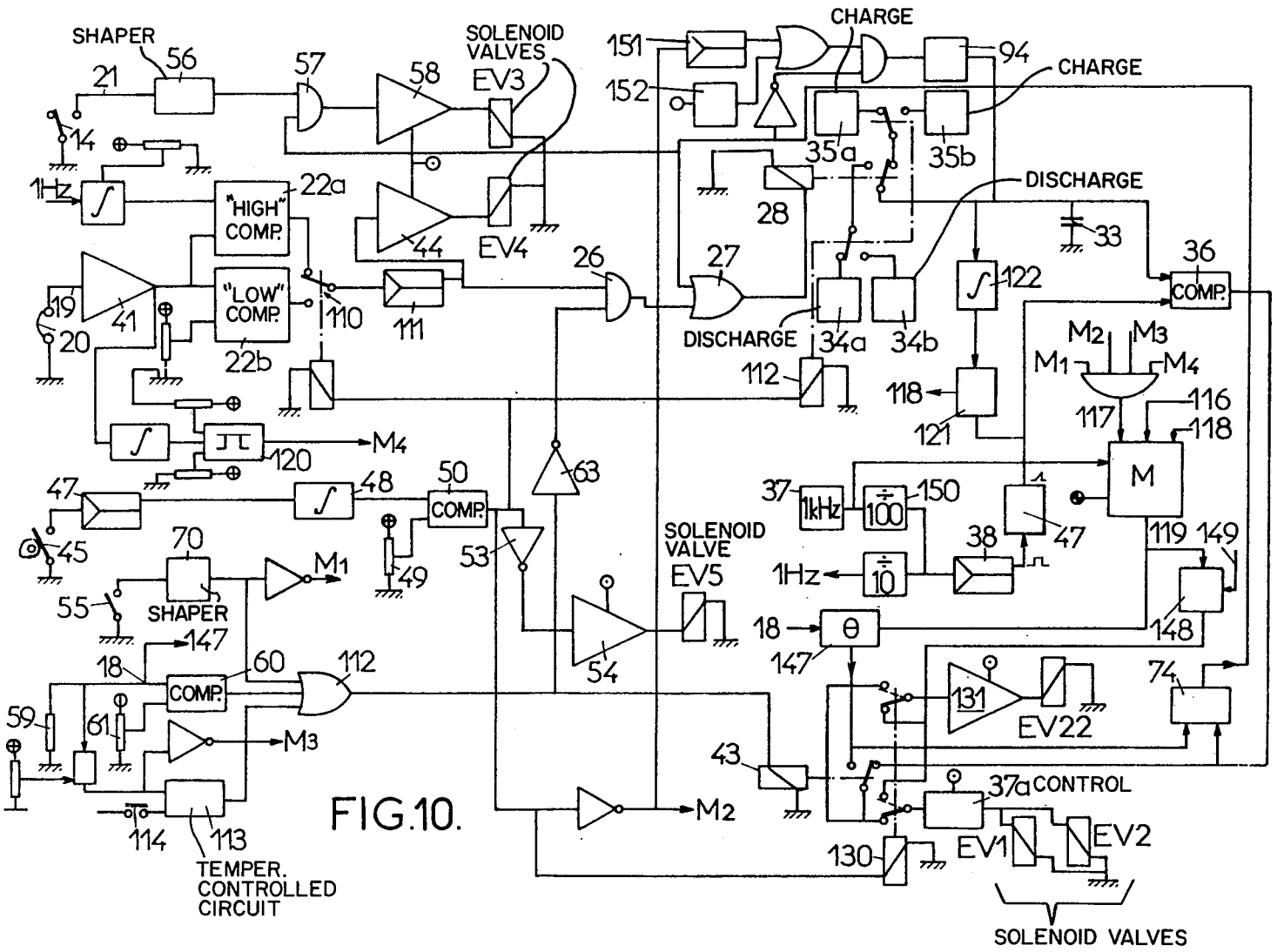
Figure 11:
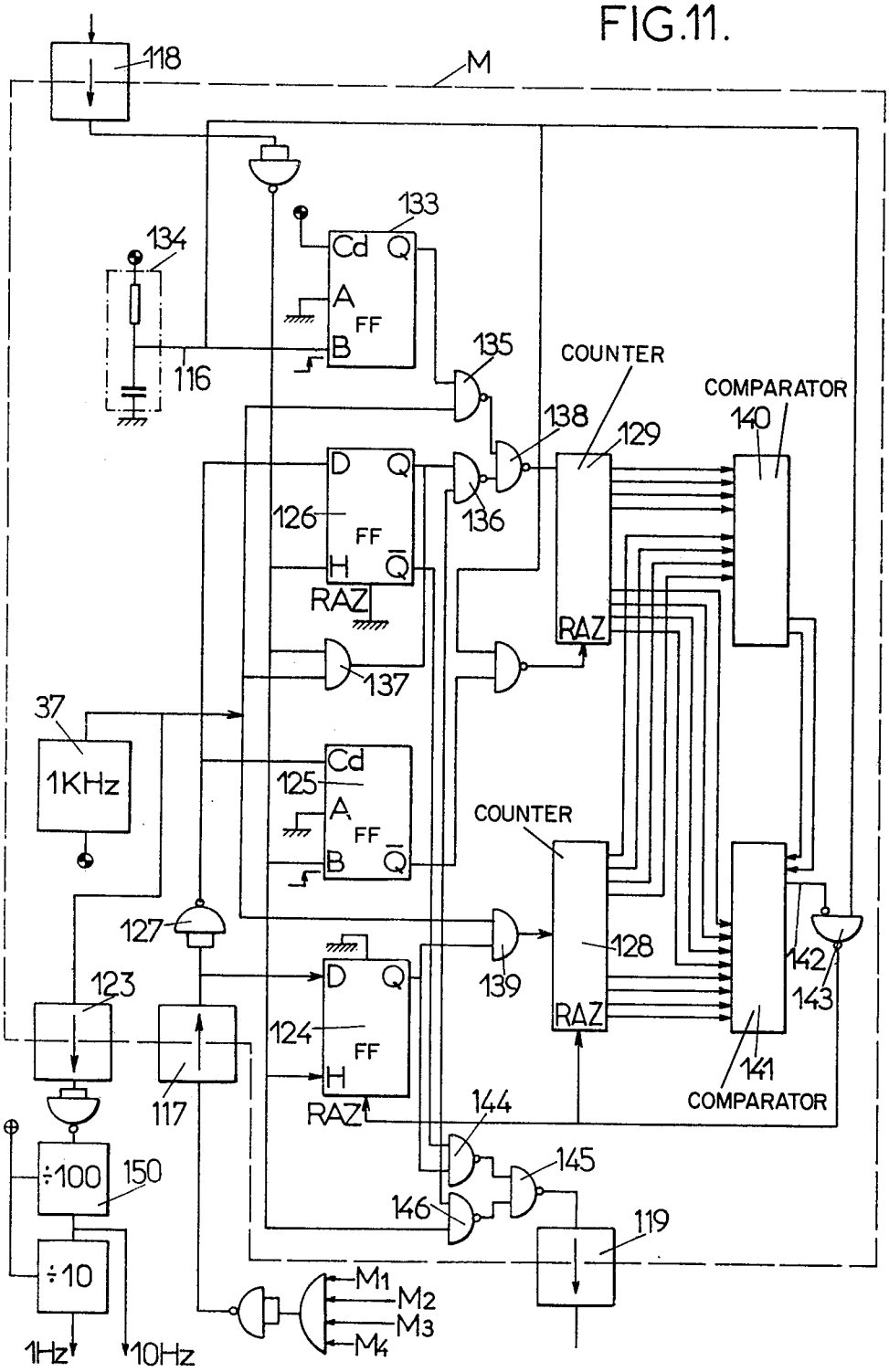
Figure 12:
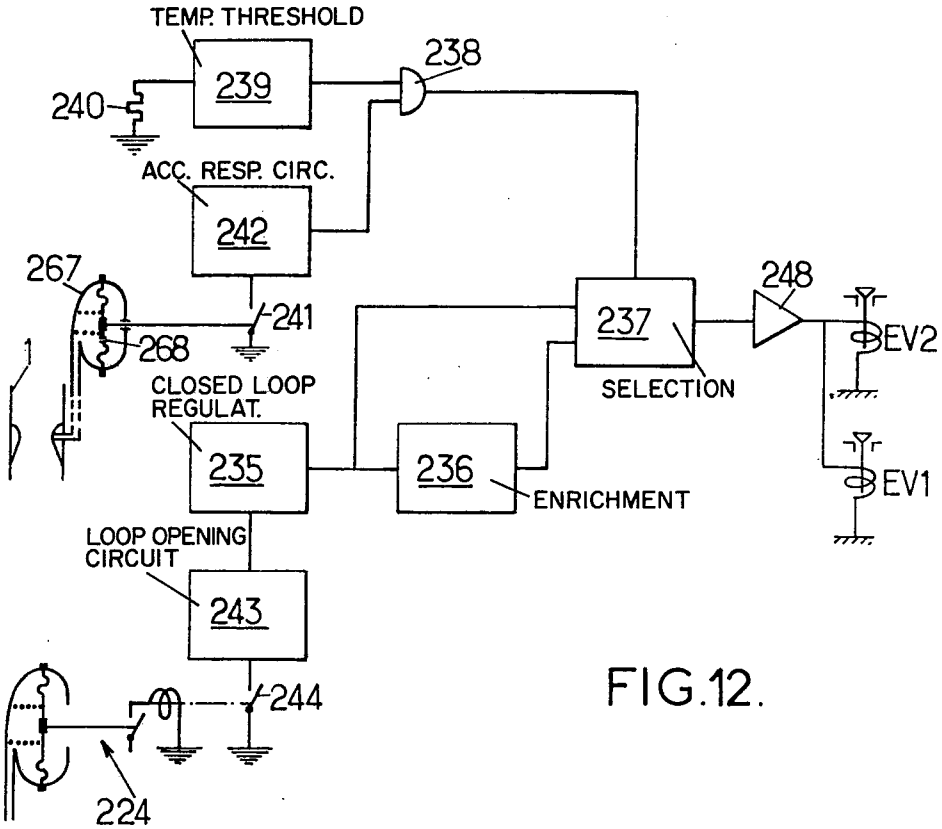
Figure 13:
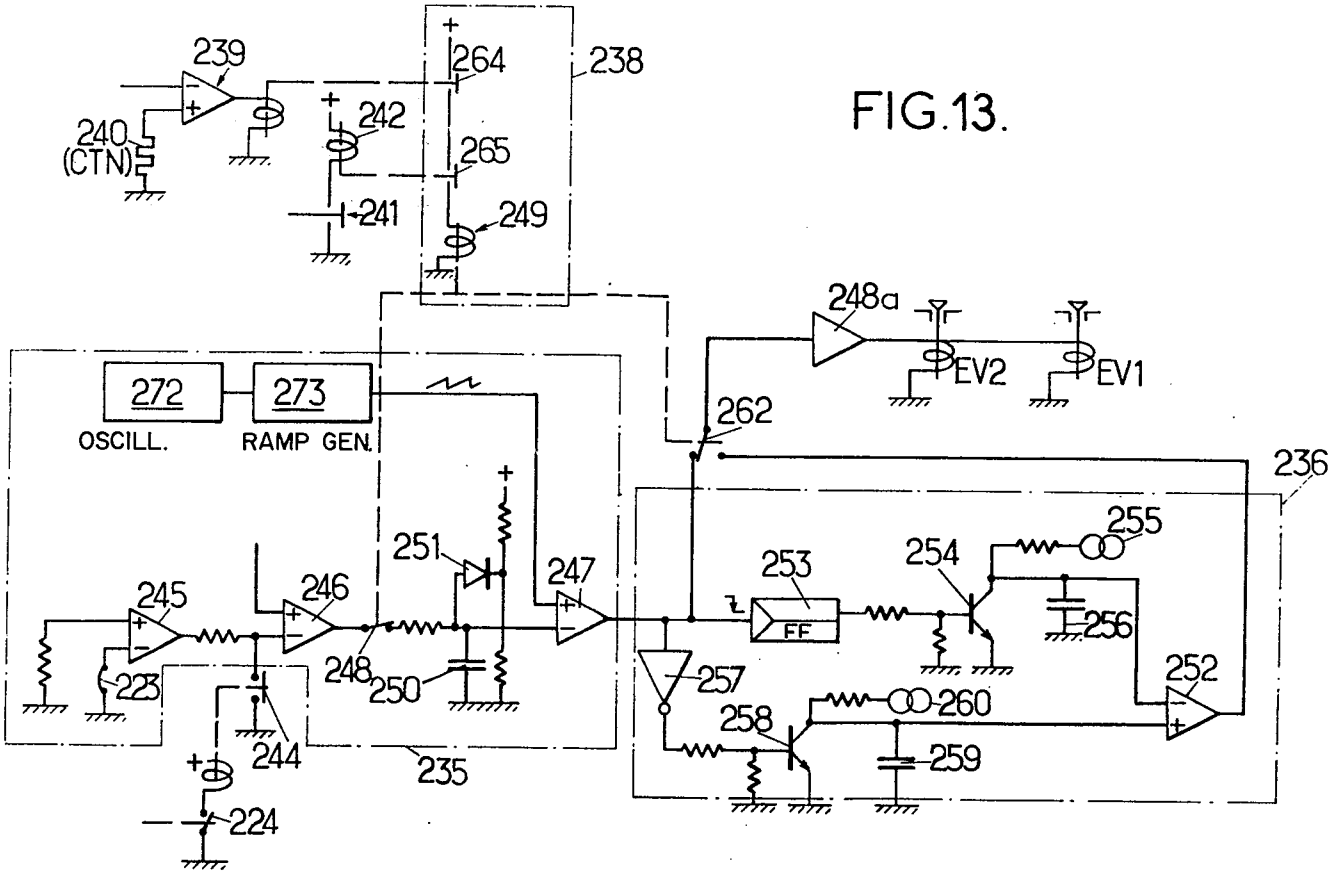

FIG. 5 shows the shapes of the signals occuring at various places in the device in FIGS. 4*a* and 4*b* during closed-loop operation;

FIG. 6, which is similar to FIG. 5, corresponds to operation during acceleration and deceleration;

FIG. 7, which is similar to FIG. 8, corresponds to open-loop operation;

FIGS. 8 and 9 show the shapes of the signals occuring at various places in the device in FIGS. 4*c* and 4*d*, i.e. when the engine heats up after cold starting and during short-circuit;

FIG. 10, which is similar to FIG. 3, shows another embodiment of the invention;

FIG. 11 shows the structure of memory means for use in the system in FIG. 10; and FIGS. 12 and 13, which are similar to FIGS. 3 and 4 respectively, correspond to a simplified embodiment.

DETAILED DESCRIPTION OF PREFERRED EMBODIMENTS

Before describing systems constituting particular embodiments of the invention, it may be useful to describe the functions performed by a particular version. To this end, reference will be made to FIG. 2, which is a curve representing the variation in the richness R of the air-fuel mixture supplied to the engine in dependence on its temperature and load condition.

Normal closed-loop operation of the device is represented by a line A corresponding to a given richness (which will be assumed equal to unity) from the minimum temperature for which the engine is designed (e.g. −30° C.) up to the maximum operating temperature. The system can be designed so that, at certain values of an engine operating parameter, closed-loop operation is represented by a line A′ corresponding to a slightly lower richness than that indicated by line A (lean fuel-air mixture).

Open-loop operation is arranged so that, under ideal conditions, the variation of richness R as plotted against temperature $\theta$ is as shown by curve B. In practice, the device can be adapted so that curve B is slightly deformed in response to variations in one or more engine operating parameters other than temperature (e.g. to allow for the speed).

Figure 1:
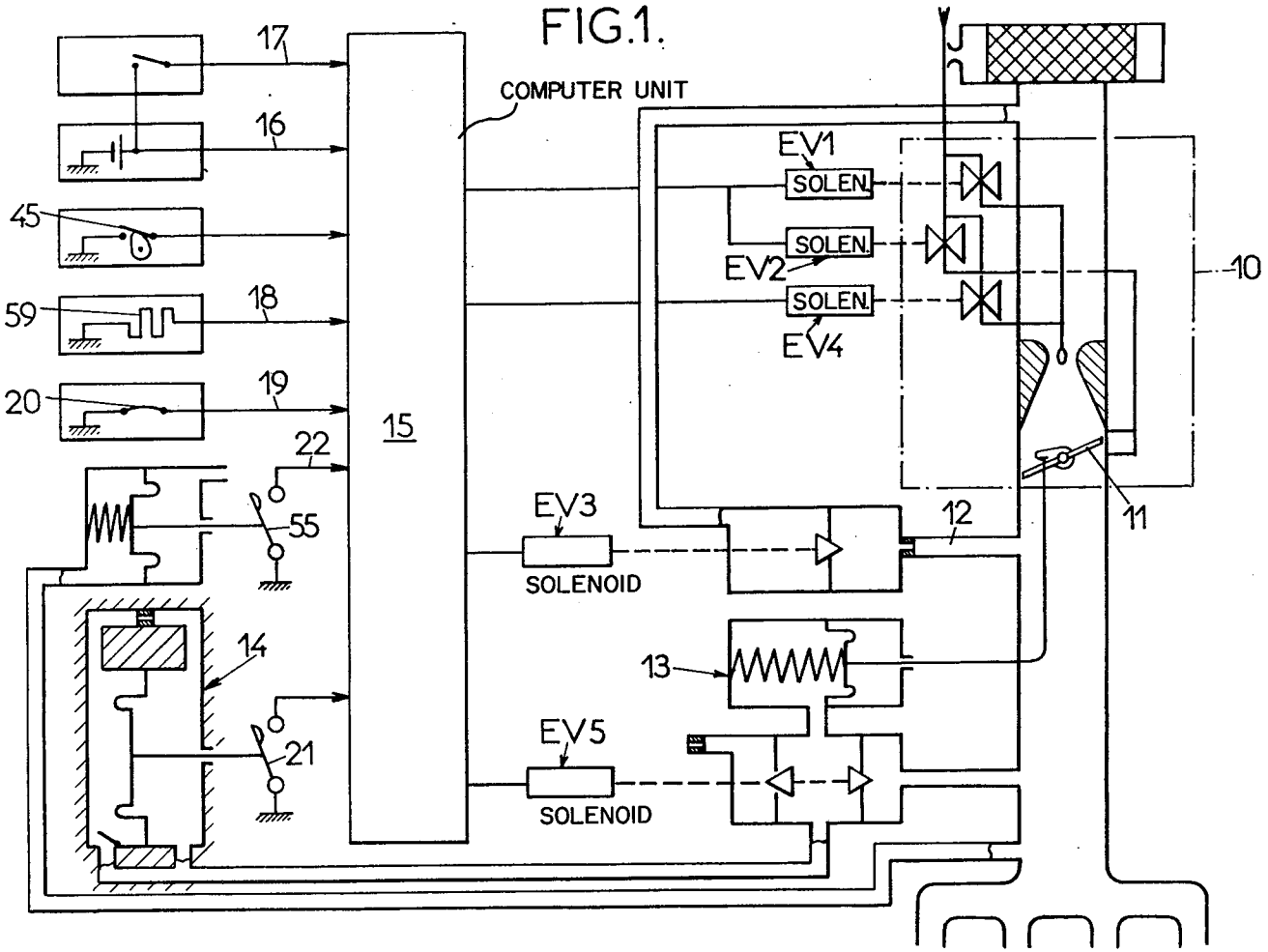
FIG. 1 is a block diagram showing the induction passage of the carburation system and its connections with the various solenoid valves.

In the case illustrated in FIG. 1, the device is arranged so that:

During operation at a temperature below a predetermined value $\theta_1$ (e.g. 20° C.), open-loop operation is compulsory, as indicated by the double line along the portion of curve B from the origin to $\theta_1$;

during a temperature interval between $\theta_1$ and a second value $\theta_2$ (e.g. 65° C.), open-loop operation occurs only during acceleration or under full load (when the carburettor throttle valve is wide open). Curve B is shown with two double-line portions, the first corresponding e.g. to an acceleration period and the second to a period of full-load operation when the engine is heating up from temperature $\theta_1$ to temperature $\theta_2$;

when the engine has heated up beyond temperature $\theta_2$, a transition to open-loop operation, represented as before by a double-line portion, occurs only under full load.

When the solenoid valve or valves in the carburation system are opened by electric rectangular signal having a variable "cyclic" ratio, the cyclic ratio will be adjusted by an electronic circuit for maintaining a given richness (i.e. unity or near unity). In that case, the transition to open-loop will be made starting from that cyclic ratio, by applying an adjustment factor $\Delta_1$ which can be in the nature of an additive correction, a multiplication factor or a more complex factor.

The method of transition will be more clearly understood from an example. If, at a given instant, a richness of 1 is obtained when the cyclic ratio or aperture ratio of the solenoid valves is 0.56, the last-mentioned value is stored. If, at a time when the engine temperature is $\theta_3$, there is a transition to open loop (e.g. as a result of acceleration), the richness is changed from 1/1 to the richness R corresponding to curve B, by adding the value 0.56 to a supplement which depends only on the engine temperature. If the supplement is 0.09, the cyclic or aperture ratio is changed to 0.65.

Instead of introducing a factor of addition, a factor of multiplication can be used (i.e. 1.16 for the value $\theta_3$).

If operation at unity richness and at temperature $\theta_3$ corresponds to a cyclic or aperture ratio of 0.48 (e.g. at a higher altitude than in the preceding case) the aforementioned multiplication factor of 1.16 will give a cyclic ratio of 0.557 instead of 0.65, during open-loop operation.

As can be seen, this takes account of the engine conditions at the time of change from closed-loop to open-loop operation.

Figure 2:
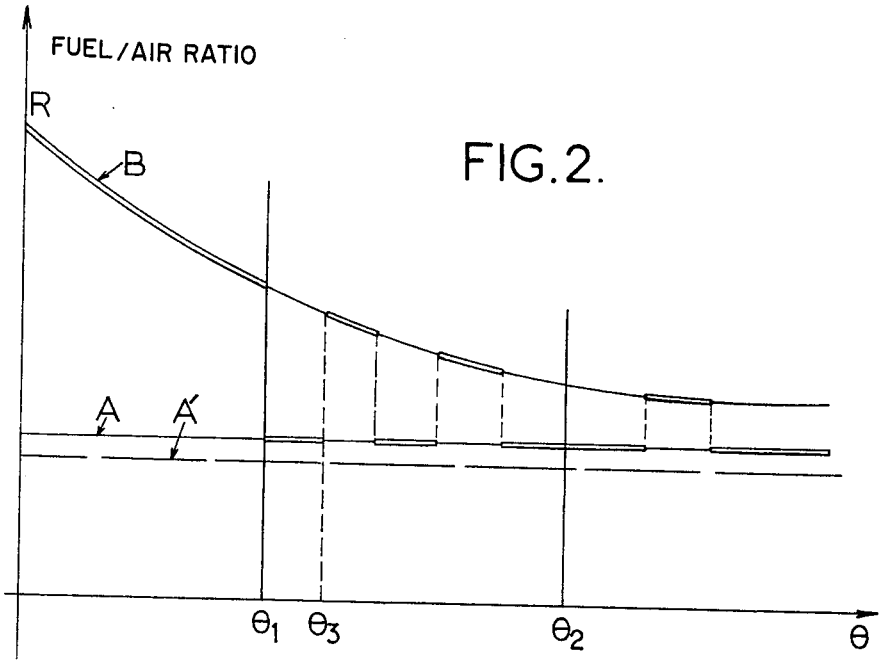
FIG. 2 is a graph showing the variation of richness with temperature during closed-loop and open-loop operation in a particular case.

The type of operation illustrated in FIG. 2 can be provided in a carburation system of the kind shown in FIG. 1. The system comprises a carburettor 10 having an induction passage provided with a main throttle means consisting of a butterfly valve 11 actuatable by an operator. The carburettor comprises a main fuel circuit opening into a venturi of the induction passage and comprising two arms connected in parallel and controlled by solenoid valves $EV_1$ and $EV_4$ respectively. An idling circuit, usually supplied with fuel from the same source as the main circuit, typically a float chamber, is controlled by a solenoid valve $EV_2$. All valves can be placed in parallel flow relation with calibrated orifices. They are open when inoperative; their construction can be as described in French Patent Application No. EN 76 14742.

A fourth electromagnetic valve $EV_3$, which is closed when inoperative, is placed in a pipe 12 connecting a place in the carburettor which is substantially at atmospheric pressure to a location downstream of throttle valve 11. Finally, a two-way valve $EV_5$ serves a double purpose; when it is not energized, it maintains atmospheric pressure in a pneumatic throttle-valve opening capsule 13 and one compartment of a deceleration pick-up 14, thus making both of them inoperative. When it is energized, it connects the automatic pneumatic throttle-valve opening element 13 and the deceleration pick-up 14 to a portion of the induction passage downstream of the throttle valve.

It will be assumed for simplicity that all the electronic circuits in the system form a computer unit 15 having four outputs which respectively control the solenoid valves $EV_1$ and $EV_2$ connected in parallel, valve $EV_4$, valve $EV_3$ and valve $EV_5$.

Computer unit 15 has two power supply inputs 16, 17 connected to the vehicle battery, one directly and the other via the ignition key. Another input is connected to a tachometer 45. Valve $EV_5$is energized when tachometer 45 indicates that the engine speed is above a predetermined threshold, which will be referred to as No.

Another input 18 is connected to a temperature probe supplying the value $\theta$. Advantageously, the probe is a CTN resistor, having a negative temperature coefficient.

Another input 19 is connected to an oxygen probe 20 placed in contact with the engine exhaust gases. It will be assumed that the probe is a $\nu$ probe, i.e. a probe having a solid electrolyte (usually doped zirconium oxide) in accordance with Nernst's law, and platinum electrodes.

Finally, an input 22 is connected to a fullload detecting means represented in the form of a switch 55 which closes when the throttle valve is wide open and an input 21 is connected to a deceleration pick-up 14, which is likewise represented in the form of a switch which closes in the event of deceleration while the speed is above a given value. Components 55 and 14 can be of known type and therefore need not be described here.

The computer unit of a system constituting a first embodiment will now be described with reference to FIGS. 3 and 3A as regards the general structure and to FIGS. 4*a*, A*b*, 4*c* and 4*d* for details.

For clarity, there will be described in succession: first, the circuit corresponding to closed loop regulation (under normal conditions and then with intervention of additional parameters), and, second, the open-loop control circuit.

Referring to the drawings, only those electric supply means which are necessary for understanding the operation of the system under special circumstances are illustrated. The general power supply 16 directly from the vehicle battery and the supply obtained via the ignition key (represented by a circle on the drawings) are used to provide an electrical supply at a regulated voltage, indicated by a circle containing a cross, and an electrical supply via a quenching circuit, the purpose of which will be described hereinafter, indicated by a circle containing a dot.

CLOSED LOOP REGULATING CIRCUIT

MAIN CHANNEL: During normal operation, the input means of the regulating circuit is a $\lambda$ probe 20 placed in the engine exhaust gases. The probe supplies an output voltage which varies abruptly on transition from a slightly sub-stoichiometric to a slightly super-stoichiometric mixture. The output signal supplied by probe 20 is applied to an amplifier 41 whose output signal is compared, by a comparator 22, to a reference value supplied by an adjustable resistance bridge 23, 24. The output voltage of comparator 22 is in the form of positive current square waves having a length corresponding to the time during which the amplitude of the positive pulses supplied by probe 20 exceeds the threshold corresponding to the reference value; the output voltage consequently consists of successive complementary negative square waves.

The square waves supplied by comparator 22 are applied to a routing circuit 25 diagrammatically represented in FIG. 3 by an AND gate 26, an OR gate 27 and a relay 28 which provide the functions of the circuit. The purpose of routing is to permit the operation of corrective channels, which will be described hereinafter.

The positive and negative square waves are applied, via the routing system, to the bases of transistors 31 and 32 (FIG. 4*a*). When a positive square wave is received, transistor 31 is blocked and transistor 32 is made conducting. A capacitor 33 (FIGS. 3 and 4*a*) discharges through a resistor 34. On receipt of a negative signal between positive square waves, capacitor 33 is charged via resistor 35. The voltage across capacitor 33 is applied to one input of a comparator 36 (FIGS. 3 and 4*b*).

The other input of comparator 36 receives a reference signal produced by a circuit comprising a capacitor 40 continuously charged by a circuit 42. Capacitor 40 is periodically discharged by an earthing switch diagrammatically represented by a switch 39 (FIG. 3) or a relay 39 (FIG. 4*b*) controlled by an oscillator 37, usually at a fixed frequency, via a shaping univibrator 38.

The output of comparator 36 is applied to a routing circuit indicated by a relay 43 on FIG. 3. When the routing circuit 43 is in the condition represented in FIG. 3, (which corresponds to engine operation at a temperature below $\theta_1$), the comparator output signal is applied to a control unit 37*a* for actuating the solenoid actuated valves $EV_1$ and $EV_2$.

ENRICHMENT CHANNEL: The aforementioned closed-loop circuit is supplemented by a system providing enrichment for reaching the stoichiometric ratio. Without that additional system, when a $\lambda$ probe is used, the air/fuel mixture supplied to the engine would be too lean for satisfactory operation of the post-combustion catalyst which is usually provided to ensure that the pollution caused by the exhaust gas does not exceed the maximum authorized level.

The enrichment channel comprises an additional amplifier 14 which is connected to the outlet of comparator 22 and constitutes a control unit for valve $EV_4$: amplifier 44 is designed for having a low time constant and providing fast adjustment.

THRESHOLD-CHANGING CHANNEL: The closed-loop circuit also comprises a threshold-changing channel for operating along line A' in FIG. 2 (i.e. on a lean mixture) when the engine speed is below a predetermined value No, indicating that the engine is idling.

The reduction in richness is advantageous when the engine exhaust is provided with a catalyst since, during idling, practically no nitrogen oxides are formed and it is advantageous to operate in an operating zone where the catalyst is most efficient at eliminating carbon monoxide and unburnt hydrocarbons.

In the system shown in FIG. 3, the threshold-changing channel comprises an additional circuit. The input component of the circuit is a speed responsive probe, i.e. the engine contact-breaker 45. Electrical pulses taken from the terminals of the primary coil 46 of the ignition winding are applied to a monostable flip-flop or univibrator 47 which produces square signals which are integrated by integrator 48. The output voltage of integrator 48 is compared in a comparator 50 with a reference voltage (having a fixed value determining the speed threshold No below which there is a reduction in richness). The reference voltage is supplied by an adjustable potentiometer 49. The output signal of comparator 50 is applied to a time delay circuit 51 which actuates a switch (indicated by a relay 52) which short-circuits resistor 24 when energized. Circuit 51 is for delaying opening or closing.

The signal supplied by contact-breaker 45 is used not only to modify the regulating threshold from probe 20, but also for other purposes, as will be seen later.

INHIBITION DURING IDLING: The output signal of comparator 50 is supplied, via an inverter 53, to an amplifier 54 for controlling the solenoid valve $EV_5$. Amplifier 54 can be adapted to prevent the mechanical opening device 13 from acting on throttle valve 11 and to inactivate the deceleration pick-up 14 when the engine speed N is below No. When valve $EV_5$ is energized (i.e. when the speed N is above No), it connects the induction passage to the deceleration pick-up 14 and the device 13 for mechanically opening the throttle valve.

CHANNEL FOR ADJUSTMENT DURING DECELERATION AT SPEED ABOVE No: An additional channel is provided for adjusting the richness during deceleration by supplying additional air, without departing from closed-loop operation, when the engine runs at a speed above No.

Starting from the deceleration pick-up 14, the additional channel comprises a shaping circuit 56 and a component (whose function is comparable to that of an AND gate) 57, having a second input connected to the output of comparator 22. The output of gate 57 is connected to a unit 58 for controlling the air valve $EV_3$.

The previously-described components are used during closed-loop operation.

OPEN-LOOP CONTROL CIRCUIT

Referring to FIGS. 3, **4*b* and 4*a***, the components which open the loop and come into action during open-loop operation will now be described under the following conditions.

The loop should be open when:

the temperature of the engine cooling circuit is below $\theta_1$; or the engine is working at full load; or there is no signal from the probe (when the exhaust gas temperature is too low).

OPENING OF THE LOOP AT LOW TEMPERATURE: The loop is disconnected when the temperature is lower than $\theta_1$ by a circuit whose input component is a resistor 59 having a negative temperature coefficient, frequently designated CTN. The output signal of resistor 59 is applied to one input of a comparator 60 whose other input receives a threshold signal supplied by an adjustable potentiometer 61. Comparator 60 supplies a logic "1" output when the temperature is below $\theta_1$ and a logic "0" output when the temperature is above or equal to $\theta_1$. A circuit comparable to an OR gate 62 transmits the comparator output signal, when it is a binary "1", to relay 43 which is thus energized, which opens the regulating loop and which connects the unit **37*a*** actuating valves $EV_1$ and $EV_2$ to an open loop control circuit which will be described hereinafter.

At the same time, the "1" output from gate 62 is inverted by a gate 63, disables the AND gate 26 and de-activates the regulating loop.

The circuit which then takes over from the loop again comprises oscillator 37. The output of oscillator 37 is connected to monostable 38 and also to a second monostable 64 which actuates switch means, shown in FIG. 3 in the form of a relay 65. Relay 65 periodically (at the frequency of oscillator 37) earths a capacitor 66 charged from a constant voltage source by a circuit 67. The voltage at the terminals of capacitor 66 is compared by a comparator 68 with the output voltage of the CTN resistor 59. The output signal from the comparator, made up of square waves having a variable cycle ratio, is applied by switch 43 to the unit **37*a*** for controlling valves $EV_1$ and $EV_2$ whose aperture ratio corresponds to the reverse of the cycle ratio.

OPENING OF THE LOOP UNDER FULL LOAD: Open loop operation can also be caused by the full-load micro-switch 55. Micro-switch 55 closes when the depression in the induction passage falls to a low value which shows that the throttle valve is wide open. Then the shaping circuit 70 maintains a logic "1" at the input of the OR gate 62, which consequently delivers a logic "1" and energizes switch 43.

OPENING OF THE LOOP AT LOW PROBE TEMPERATURE: The system further comprises a channel which comes into action when probe 20 does not supply a significant signal because its temperature is too low (during cold starting of the engine) so that closed loop operation would be jerky. The channel comprises a summation circuit 71 which adds the output voltage of resistor 59 to a value adjusted by means of a potentiometer 72. The output voltage of 71 is applied, via a line 73, to an input of a comparator 74 whose other input receives the voltage across capacitor 33. If, during open-loop operation, the comparator 74 detects that the voltage has been exceeded, it delivers a logic "1" which is applied to the input of the OR gate 27 and holds switch 28 in the position in which capacitor 33 discharges. In the contrary case, comparator 74 recharges capacitor 33 via a circuit 94. The operation of the last-mentioned channel, in the particular embodiment shown in FIGS. **4*b*, 4*a* and 4*c***, will be described in greater detail hereinafter.

Referring now to FIG. 3A, construction of unit **37*a* controlling the solenoid valves $EV_1$ and $EV_2$ will now be described. The units assoiciated with the other valves can be very similar to unit 37*a***. The main features of the power supply and quenching system will also be described.

Unit **37*a* is constructed for it to be functionally equivalent to an OR gate 75 which receives a signal transmitted by switch 43** and also receives a signal from a "hold" channel which will be described hereinafter.

The signal transmitted by OR gate 75 is applied, via a power amplifier 76, to the windings of the electromagnetic valves $EV_1$ and $EV_2$.

System 77 comprises the following components, starting from input 16 which is permanently connected to the vehicle battery: a first arm containing the ignition key switch 85 and a second arm containing a switch 78, diagrammatically indicated as the moving contact of a relay. The second arm supplies a quenching output 79 and a voltage regulator 80 which maintains, on an output 81, a stable voltage for producing the various thresholds and supplying the electric components.

The winding associated with contact 78 receive electrical power from downstream of the ignition key 85 via a delayed-opening circuit 82.

The power supply voltage will consequently be available at outputs 79 and 81 for a given time after opening the ignition key 85. FIGS. 3 and 3A also show that the power amplifiers for closing the solenoid valves are supplied from output 79, so that after the ignition is cut off, the valves remain closed for a time which is fixed by a circuit 82 and is adjusted to prevent any return to operation through auto-ignition.

Starting from input 17, circuit 77 comprises a shaping circuit 83 and an inverter 84 which acts on the second input of the OR gate 75 and fulfills a function to be described hereinafter.

Referring now to FIGS. 4*a*, 4*b*, 4*c* and 4*d*, there will be described a particular embodiment of the system using an integrated circuit or a printed circuit on to which discret packages of components are welded. The components corresponding to those in FIGS. 3 and 3A are indicated by the same reference numbers.

The system shown in FIGS. 4*a*, 4*b*, 4*c* and 4*d* uses logic components which are most of them AND gates which can be built from commercial C-MOS circuits. The system can be simplified by using bipolar circuits.

CLOSED-LOOP REGULATION CIRCUIT: Referring to FIG. 4G, there is again found a probe 20, which is connected to the input of an amplifier 41, the bias circuit of which is omitted for simplicity. Comparator 22 receives the output signal from amplifier 41 at its positive (+) input and the threshold signal at its negative (−) input. In the present case, the switch 52 for modifying the threshold level is a transistor which, when saturated, short-circuits resistor 24.

The routing system 25 comprises two NAND gates 29, 30 connected in cascade and outputting positive or negative square waves which are applied to the bases of transistors 31 and 32. When gate 30 delivers a positive voltage, transistor 31 is blocked and transistor 32 is conducting; capacitor 33 discharges according to an exponential law with a time constant which depends on the value of resistor 34. The time constant RC is e.g. 48 s. When the voltage is negative, i.e. during a negative square wave, transistor 32 is blocked whereas transistor 31 is saturated. Then capacitor 33 is progressively charged according to an exponential law determined by the value of resistor 35, with a time constant RC which is e.g. five times greater than during discharge.

The voltage at the terminal of capacitor 33 is applied to the negative input of comparator 36 (FIG. 4*b*). The positive input of 36 is associated with a circuit comprising the elements already shown in FIG. 3, i.e. an oscillator 37 (FIG. 4*a*), typically having a fixed frequency, a monostable 38 (FIG. 4*a*), a switch 39 consisting of a transistor (FIG. 4*b*), a charging circuit 42 (having an RC constant of e.g. 1 second) and a capacitor 40.

It is unnecessary to describe oscillator 37, which may be conventional in construction, and monostable 38, the "set" duration of which is less than the period of oscillator 37 (e.g. 25 ms for a frequency of 10 Hz). As long as monostable 38 is set and delivers a square wave output, its Q output is positive, transistor 39 is saturated and capacitor 40 is maintained discharged. For the rest of the time the Q output of monostable 35 is negative, transistor 39 is blocked and capacitor 40 is charged in accordance with an exponential function via the resistor of the charging circuit 42.

The previously described part of the system operates as shown in FIG. 5. In FIG. 5, the upper two lines, marked 37 and 38, show the output signals of oscillator 37 and monostable 38, respectively. Curves 33 and 40 (third line) show the variations in the voltages applied to the terminals of comparator 36 (exponentially increasing voltage across capacitor 40 and average voltage across capacitor 33).

When the voltage across capacitor 40 exceeds the voltage across capacitor 33, comparator 36 supplies a positive voltage square wave (line 36 in FIG. 5). The positive square wave enters the routing system 43 (FIGS. 3 and 4D) and energizes the unit which controls solenoid valves $EV_1$ and $EV_2$. Referring specifically to FIG. 4D, there is shown a possible embodiment of system 43, built with NAND gates.

It can be seen that when the voltage across capacitor 33 is low (when the voltage supplied by probe 20 is below the threshold for a longer time than above it, indicating that the fuel/air mixture is somewhat lean), the closure time of valves $EV_1$ and $EV_2$ as compared with the period of repetition of the openings correspondingly decreases and there is a corresponding increase in the amount of fuel supplied to the induction passage.

Referring to FIG. 4*a*, there is shown an enrichment channel for bringing the mixture to the stoichiometric ratio if valves $EV_1$ and $EV_2$ are not sufficient for fulfilling that object during closed-loop operation. The positive and negative square waves from comparator 22 are directly applied to the unit 44 which actuates the electromagnetic valve $EV_4$.

There is also shown in FIG. 4*a* the threshold changing channel for regulation during idling, when the motor should run on a slightly lean mixture. A conventional circuit 78*a* maintains a voltage across capacitor 79, the voltage being approximately proportional to the speed of the engine. Circuit 78*a* can comprise a monostable which is trigerred every time contact-breaker 45 is closed, and outputs periodic signals which are integrated by capacitor 79, which is connected in parallel with a leakage resistor. The voltage across capacitor 79, which corresponds to integrator 48 in FIG. 3, is applied to one input of comparator 50, the other input of which receives an adjustable threshold voltage representing the selected speed No.

In the embodiment illustrated in FIG. 4, the channel operates differently depending on whether the engine is accelerating or decelerating, as shown in FIG. 6.

(a) During deceleration, i.e. when the engine is slowing down from a speed N above No to a speed N below No (N being equal to No at instant $t_2$ on FIG. 6), the voltage at the negative input falls below the voltage at the positive input (FIG. 6, line 50). The output of amplifier 50 becomes positive. Thereupon, a feedback resistor 80*a* modifies the voltage applied to the positive input, produces a hysteresis and prevents the system from oscillating as a result of slight variations in voltage across capacitor 79. The output of amplifier 50 becomes negative. The resulting negative pulse is inverted by a NAND gate 81*a* (line 81), then applied to the input of a monostable 82 whose Q output thereupon supplies a negative pulse (line 82 in FIG. 6). The output of a second NAND gate 83, connected to the Q output of 82 and to the output of a second inverter 84 connected in cascade with 81*a*, supplies a negative signal at the end of the square wave from monostable 82 (fourth line in FIG. 6).

The output of NAND gate 81*a* also controls a monostable 87, which is set by the rising edges of the pulses (whereas 82 is trigerred by the descending edges). Output Q of 87 remains positive whereas the level at the output of 82 changes level (fifth line in FIG. 6). Consequently, a signal appears at the output of NAND gate 85 (sixth line) and renders conductive a transistor constituting the switch 52, thus lowering the potential of the negative input of comparator 22 and consequently lowering the comparison threshold of probe 20. At the same time, $EV_5$ closes and inactivates the device 13 opening the throttle valve 11.

(b) During acceleration, i.e. when N increases beyond No, the monostable likewise acts to provide a time delay. FIG. 6 shows the variations in voltage from the instant $t_1$ when N becomes greater than No, and the time durations during which $EV_5$ is energized and the threshold is modified (last line).

The channel for correction during deceleration comprises a micro-switch 14, an anti-rebound circuit 88*a* (of conventional construction) for avoiding instability during the relatively slow motion of micro-switch 14 and two NAND gates equivalent to the AND gate 57 in FIG. 3. During deceleration while the speed is above No, the first NAND gate receives two positive levels on its inputs; it energizes the unit 58 which controls $EV_3$, which opens.

OPEN-LOOP CONTROL CIRCUIT

The construction of the embodiment illustrated in FIGS. 4*a* and 4*b* together with its operation under various conditions will now be described.

Operation is in open loop either when the probe does not supply a representative signal (i.e. when the exhaust-gas temperature is below approx. 300° C.), or when temperature $\theta$ is below a predetermined threshold $\theta_1$, or when the engine is under full load, irrespective of its temperature.

The temperature $\theta$ of the engine cooling circuit is converted into a variation of electric potential by pick-up 59 (which will be assumed to be a CTN resistor) associated with conventional resistors.

The resulting output signal is transferred to three channels which will now be described in succession.

CHANNEL 1: Adjustment of the aperture ratio of the solenoid valves (FIG. 7). The output signal from CTN resistor 59 is applied to the negative input of a comparator 68, comprising a differential amplifier, which determines the cyclic or aperture ratio.

The positive input of comparator 68 receives signals from a circuit comprising an oscillator 37, a monostable 64 which is set at the same time as monostable 38 and then results in charges and discharges of capacitor 66 via transistor 65 (which is equivalent to relay 65 in FIG. 3).

The output of comparator 68 is positive as long as the potential across capacitor 66 is above the potential from CTN resistor 59. The resulting positive square waves are delivered to unit 37*a*, controlling $EV_1$ and $EV_2$, by the routing circuit formed by NAND gate 88 (corresponding to gate 62 in FIG. 1) and a set of logic gates 43.

Since the CTN resistor 59 has one end which is earthed, the potential at its other end is very low when the engine is hot, i.e. when its resistance is low. Consequently, the suare waves supplied by comparator 68 would be very long if the "set" duration of monostable 64 were the same as that of monostable 38. Consequently, monostable 38 is selected for its "set" time to be much longer than that of 64, so that the longest duration which can be provided by 68 is lower than the time duration determined by the other comparator 36.

Referring to FIG. 7, the operation as indicated above is illustrated. In FIG. 7, from bottom to top, there are shown the output voltage of oscillator 37, the voltage at the output of monostable 64, the voltages at the negative and positive inputs of comparator 68, and the solenoid-valve closure signals supplied by unit 37*a*.

CHANNEL 2: Loop-opening and routing. The output signal of CTN resistor 59 is applied to the negative input of comparator 60 which controls the routing of the signals from comparators 68 and 36.

When the electrical potential from CTN resistor 59 is greater than the reference potential supplied by potentiometer 61, the output of comparator 60 becomes negative. Since the other input of NAND gate 88 (upstream of the routing system 43) is then negative, the output of NAND gate 88 is positive. Consequently, the output of the next gate 89 is negative. Consequently a NAND gate 90 of routing system 43 has one permanently negative input and one input which is alternately positive and negative, depending on the state of the output of comparator 36.

Consequently, the output of gate 90 remains positive and the signals from the closed-loop commuting circuit do not reach the unit 37*a* controlling $EV_1$ and $EV_2$.

On the other hand, the NAND gate 91 receiving the signals from 88 and 68 has a positive input and a second input which receives the square waves from 68. The square waves are transferred to the output of 91 and thence to the output of another NAND gate 92 whose other input remains positive. The square waves are thus transferred to unit 37*a* (FIG. 4D).

CHANNEL 3: Limitation of the charge on capacitor 33.

This channel initiates operation when the cold engine is cranked and avoids jerky operation during the transition from open-loop to closed-loop conditions, as already indicated with reference to FIG. 3.

Starting from CTN resistor 59, the third channel comprises an amplifier-follower and a summation circuit 71 which adds a fixed voltage, supplied by potentiometer 72 to the voltage supplied by CTN resistor 59. The output of circuit 71 is applied to the positive input of comparator 74, whose negative input receives the potential from capacitor 33.

COLD START: During a cold start, the output of NAND gate 89 (which operates as an inverter) of routing system 43 is negative. It is applied to the input of NAND gate 29 and the output of comparator 22 is negative, showing the absence of a signal from the CTN resistor.

Since capacitor 33 is not charged and there is no voltage across it, the output of the amplifier-follower constituting the output stage of comparator 74 is positive. The output of NAND gate 30 is therefore negative, so that transistor 31 is conductive and capacitor 33 is progressively charged.

The charging process via transistor 31 will be relatively slow. In order to speed up the process, the output of comparator 74 (which is then positive) actuates a charging circuit 94 which can be of conventional construction and need not therefore be described.

As soon as the potential at the negative input terminal of comparator 74 is equal to that due to CTN resistor 59, the output of the amplifier-follower forming the second stage of comparator 74 becomes negative, thus finally stopping the rapid charging of capacitor 33. As can be seen, therefore, circuit 94 operates when the engine starts.

When the output of 74 becomes negative, it modifies the input of NAND gate 30 whose output becomes positive, thus blocking the charging transistor 31, stopping the process of charging capacitor 33 and making transistor 32 conductive, so that it discharges capacitor 33 until the potential at the output terminal of the high-frequency (e.g. 1 MHz) oscillator applied to the input of comparator 74 falls below the potential supplied by CTN resistor 59. During subsequent operation, therefore, there are oscillations at a high frequency.

As λ probe 20 heats up, it begins to produce square waves at the output of comparator 22 but this makes no difference to the condition of the output of NAND gate 29. Capacitor 33 holds a voltage which is defined only by the resistance of CTN resistor 59.

TRANSITION TO CLOSED-LOOP REGULATION

When the engine heats up, the resistance of CTN resistor 59 and the voltage across it decrease.

When the temperature $\theta_1$ is reached, output 60 becomes negative, the output of gate 88 becomes negative and the output of gate 91 becomes positive. The square waves from comparator 22 are transferred by gates 29, 30 to the bases of transistors 31 and 32, which alternately charge and discharge capacitor 33. The device is thus regulated responsive to the signal supplied by λ probe 20.

The change in condition of the output of comparator 60 has another effect: it blocks transmission of the square waves from comparator 68 via circuit 43, but authorizes transmission of the square waves from comparator 36.

If, during closed-loop regulation, the voltage across capacitor 33 exceeds the voltage produced by CTN resistor 59, comparator 74 operates again as during cold starting, applies a negative level to gate 30 whose output becomes positive, makes transistor 34 conductive and discharges capacitor 33. Thus, the regulating system can operate only in the vicinity of a value determined by resistor 59.

This kind of operation is shown in FIG. 8, in which the lines from top to bottom respectively illustrate:

- the law of voltage increase across a capacitor constituting the input component of circuit 94, starting from instant $t_o$ when the ignition key is closed;
- the output voltage of circuit 74;
- the voltage at the positive input 71 of summation circuit 71, at the output of circuit 71, and across capacitor 33;
- the voltage at the output of amplifier 22;
- the voltage at the outputs of gates 89, 29 and 30;
- the voltage at the output of amplifier 60;
- the voltage at the output of gate 96; and
- the voltages across capacitors 99 and 100, respectively.

Referring to FIG. 4*c*, there is shown a quenching system 77 which may be embodied in the system of FIGS. 4*a* and 4*b*.

During normal operation, terminal 17 is brought to the battery voltage through the ignition key, thus saturating transistors 95 and 96 and actuating relay 78, which then supplies the main voltage regulator 80 (FIG. 3A) from the battery, thus supplying all the circuits together with the solenoid valve control units.

In addition, the battery voltage appearing at 17 is transmitted to an input of NAND gate 97 (FIG. 4D) whose other input receives the control square waves from gate 98. The control square waves travel across 97 and actuate solenoid valves $EV_1$ and $EV_2$.

As soon as point 17 is energized, capacitors 99 and 100 are being charged.

When the contact is cut, capacitor 99 discharges into the resistive circuit connected in parallel with it. During the time necessary for discharge, relay 78 remains energized and the electronic assembly remains supplied with current.

The voltage across capacitor 100 becomes negative, so that the input of NAND gate 97 is at a negative voltage. The output of gate 97 therefore becomes positive, thus energizing solenoid valves $EV_1$ and $EV_2$ during the entire time when relay 78 is energized. The time constant is selected so that the solenoid valves remain closed during the time required for quenching.

After capacitors 99 and 100 have discharged, the circuit is automatically disconnected from the electrical power supply.

Each solenoid valve preferably has a circuit for protecting its control unit from damage in the event of a short-circuit, due e.g. to faulty handling of the wires connecting the computer unit to the solenoid valves. By way of example, FIG. 4*d* shows a circuit for valve $EV_5$. The other valves can be provided with similar circuits.

The protective circuit 54 in FIG. 4*d* uses a comparator which blocks the input control pulses if a short-circuit occurs.

A short-circuit of the above-defined kind makes transistor 101 conductive, so that it applies a positive level to the input of NAND gate 102. When the control signal reaches the other input of NAND gate 102, its output becomes negative. The output of NAND gate 103, which is connected to form an inverter, becomes positive, so that transistor 104 becomes conductive and transistor 105 is disabled, thus blocking the power stage of the control unit.

Operation of the protection circuit is diagrammatically indicated in FIG. 9 in which the lines, from top to bottom, show: the signals at the output of gate 81; the voltage applied to the winding of valve $EV_5$; the voltage at the collector of 101; the output of gates 102 and 103; and the voltage at the collectors of 104 and 105. It is assumed that short-circuit conditions have existed during time Δt.

The system which has been described with reference to FIGS. 3 and 4 performs satisfactorily, both under normal load and under temporary or exceptional conditions such as cold starting, operation under full load, and acceleration. It also ensures a steady transition from one kind of operation to another, inter alia during the transition from open-loop to closed-loop operation, which begins without any change in the cyclic or aperture ratio of the solenoid valves, since the electric charge of capacitor 33 is forcibly established.

However, in a further refined system, the following additional functions are also performed:

The cyclic or aperture ratio of the solenoid valves is stored during closed-loop operation, and open-loop operation is brought about by adjustment starting from the stored value;

A plurality of regulating speeds are provided, and the most appropriate speed is selected taking into account the engine operating conditions; and The temperature of the engine lubricating oil is taken into account, in order to determine if operation is to be closed-loop or open-loop.

A particular embodiment of the invention which fulfils the above functions will now be described with reference to FIG. 10, which is a block diagram similar to FIG. 3, and to FIG. 11 which shows a particular construction of the memory unit in the system.

For simplicity, those components which correspond to those in FIG. 3 are denoted by the same reference number and will not be described in detail again.

Referring to FIG. 10, there is shown a circuit for a double barrel carburation device for an engine provided with a post-combustion catalyst. For the catalyst to operate satisfactorily, it must receive exhaust gases having a composition which is not exactly that corresponding to the "bend" in the characteristic curve of a λ probe. Since the device has two barrels, there is a idling solenoid valve $EV_2$ for the first barrel and an additional solenoid valve $EV_{22}$ for the second member. The two solenoid valves can be used to prevent faulty operation during a change of operating conditions, since one valve can be controlled for closed-loop operation and the other can simply be adjusted for open-loop operation at certain speeds.

CLOSED-LOOP REGULATION CIRCUIT

MAIN CHANNEL: Referring to FIG. 10, the system again has a probe 20 and a corresponding amplifier 41. However, the output of the amplifier is simultaneously applied to a "high" comparator **22*a* and a "low" comparator 22*b*. The output of comparator 22*a* or 22*b*, depending on the position of the moving contact of a selector 110 represented in the form of a relay, is applied to AND gate 26 via a monostable 111** whose object is to delay modification towards a leaner air-fuel mixture.

Relay 110 performs a similar function to relay 52 in FIG. 3 except that there is a substitution of one comparator for another instead of modification of a threshold during idling. Relay 110 is controlled by contact-breaker 45 via monostable 47, integrator 48 and comparator 50 so that, during idling (when the speed N is below a predetermined value No), the "low" comparator cooperates with monostable 111. During idling, the output signal of comparator 50 further opens valve $EV_5$.

The "high" comparator **22*a* is operative when the engine runs above the idling speed. The threshold of comparator 22*a*, which is higher than that of comparator 22*b***, is modulated at a low frequency, e.g. 1 Hz. The threshold voltage varies e.g. by an amount of 30% over one period. Consequently, excess oxygen is supplied at a frequency of 1 Hz, which helps to preserve the catalyst.

The balance of the main channel is similar to that shown in FIG. 3, the only difference being that it comprises two sets of discharging and charging circuits instead of one. The first set comprises a constant current charging circuit **35*a* and a discharging circuit 34*a*. The second comprises corresponding circuits 35*b* and 34*b*** which are likewise provided for a constant—but weaker—current, corresponding to a lower regulating speed.

A switch 112, which is likewise shown as a relay, is used for transition from one set to the other. The winding of relay 112 is controlled by the output of comparator 50. During idling, the time constant for the regulating process is longer than under other conditions, thus adapting the regulation speed to the engine time constant during idling.

During closed-loop operation, the output of loop comparator 36 is connected to **37*a* via switch 43 and an additional switch 130**, the object of which will be described hereinafter.

ENRICHMENT CHANNEL: Under all conditions except idling, solenoid valve $EV_4$ is periodically energized by square waves from monostable 111, and raises the richness of the mixture supplied to the engine to the level required for proper operation of the catalyst. That channel is a fast-regulation channel.

LOOP DISCONNECTION: The loop may be opened by relay 43, which is energized by an OR gate 112 whose input terminals are connected as follows:

A first input is connected to comparator 60, which receives the output signal of the CTN resistor 59 and delivers a "1" logic level if the cooling-water temperature is below $\theta_1$, a "0" level in the contrary case;

a second input is connected to the pulse-shaping circuit 70 associated with the full-load micro-switch 71 and delivers a "1" level if the engine is under full load; and the third input is connected to a circuit 113 which delivers a "1" if $\theta < \theta_2$ ($\theta_2$ being a predetermined value above $\theta_1$) and if simultaneously a thermocontact 114 is closed, indicating that the engine lubricating oil is at a temperature below a given value (e.g. 17° C.).

The latter input is for maintaining open-loop operation after cold starting even when the water (which heats up more rapidly than the engine) has reached a normal temperature.

The loop is also open during idling, due to the application of a "1" level from comparator 50 to relay 130. A first moving contact of relay 130 separates unit **37*a* from switch 43 and connects it to a second channel which will be described hereinafter. A second contact connects relay 43 to the control unit 131 of the idling solenoid valve $EV_{22}$ associated with the second barrel, so that during idling there is open-loop control of valves $EV_1$ and $EV_2$ whereas valve $EV_{22}$ is associated with the regulating loop (the contacts of relay 130 being in the position shown in broken lines in FIG. 10**).

OPEN-LOOP CONTROL CIRCUIT

The regulating circuit in FIG. 10 is designed so that during open-loop operation valves $EV_1$ and $EV_2$ have a cyclic aperture ratio (RCO) which not only depends on temperature $\theta$ but is determined by adding an adjustment term to a value previously stored during closed-loop operation.

The control circuit further comprises means for preventing jerky operation upon opening or closing of the regulation loop.

MEMORY: To this end, the control circuit comprises a memory M for storing a member which represents the RCO value prevailing during closed-loop operation, for very long periods if necessary. The memory can be of the kind illustrated in FIG. 11, which mainly comprises counters, comparators and flip-flops. The contents of the memory has to be preserved if the engine is stopped. For that purpose, memory M has a permanent power supply from the vehicle battery. The battery EMF may be much less than its rated value during very cold weather. To obviate the consequences of this voltage drop, memory M is supplied via a voltage regulator which lowers it to a constant voltage considerably below the rated EMF of the battery (e.g. 6 V instead of 12 V). This type of supply is indicated in FIGS. 10 and 11 by a circle 15 containing two opposed black sectors.

Memory M is connected to the balance of the circuit via:

- an input 116 for setting an initial RCO (e.g. 0.55) if the memory is erased;
- an input 117 enabling refreshment (up-dating) of the memory;

a counting input connected to a time base, which is advantageously common to the entire circuit and in the illustrated embodiment is a clock 37, e.g. at 1000 Hz;

an input 118 for applying an average RCO value, formed from the signal applied to the loop comparator 36; and a data output 119.

The up-dating control input 117 is used to avoid storing a non-significant RCO value. Input 117 is energized by the output signal of an AND gate whose inputs are connected to points $M_1$, $M_2$, $M_3$, $M_4$ of the circuit in FIG. 10. As can be seen, up dating is authorized only if the following conditions are simultaneously fulfilled:

load below full load ($M_1$ input);

speed above idling speed ($M_2$ input);

water temperature $\theta$ above $\theta_2$ ($M_3$ input), and output signal from a window comparator 120 indicating that the output signal of probe 20 is between two predetermined values ($M_4$ input), which shows that the air/fuel ratio is near stoichiometric and the regulation loop is operative.

The signal representing the average RCO and applied to input 118 is generated by a circuit similar to that in FIG. 3, but using a single saw-tooth oscillator 37. Oscillator 37 is connected to a divider-by-a hundred 150 followed by a monostable 38 and the constant current charging circuit 47, the output of which is connected to an input of a comparator 121. The voltage across capacitor 33 is integrated at 122 using a time constant which may be of the order of one minute and applied to the other input of comparator 121.

As a consequence, the output signal of comparator 121 is a signal consisting of square waves at 10 Hz representing the average RCO computed from the signal from probe 20.

Referring to FIG. 11, the memory comprises flip-flops and counters whose power sources (not shown) are connected to the lower voltage regulator. In the embodiment shown in FIG. 11, oscillator 37 is integrated with the memory, which is likewise supplied from the lower voltage source. The same applies to the input and output interfaces 117, 118 and 119 which, like the 1000 Hz output 123, comprise conventional opto-electronic couplers.

Before describing the structure of the memory it may be useful to indicate its function.

When the memory up-dating control input is energized, a counter is made to count up at 1000 Hz during the time period between the leading edge and the trailing edge of the square wave representing the average RCO after clearing (RAZ) responsive to the leading edge. Since the square waves are provided at a frequency of 10 Hz, the average RCO will be stored in the form of a number from 0 to 100. The memory is associated with routing circuits and initiating circuits, for writing an initial RCO equal to 0.55.

The memory has four input flip-flops. A first monostable flip-flop 133 is associated with a time delay circuit 134 so as to be energized and supply a square wave representing the cyclic ratio 0.55 when the delay circuit 134 is energized after a complete break in the power supply. The other three flip-flops 124, 125 and 126 each receive the 10 Hz signal representing the average RCO, arriving via coupler 118, and the enabling signal arriving via coupler device 117, after inversion at 127 in the case of flip-flops 125 and 126.

The bistable flip-flop 126 receives the enabling signal and the 10 Hz signal at its inputs D and H respectively. The monostable 125 receives the same signals at its inputs $C_d$ and B respectively (input A being earthed). The same signals are applied to inputs D and H of flip-flop 124.

The levels appearing at outputs Q of flip-flops 126 and 125 and output Q of flip-flop 124, respectively, are applied to gates supplying two BCD counters 128 and 129 operating in binary-coded decimal system and each having eight bits, i.e. four of weight 1 and four of weight 10. The gates control the transmission to counters 128 and 129 of the 1000 Hz pulses from oscillator 37.

Counter 129 is used for providing a representation of the closed-loop RCO in the form of a number of pulses, the maximum number being 100. NAND gate 135 is blocked except for the restarting periods after the supply has been cut off. Gate 136 is enabled during each time interval between a leading edge and a trailing edge of a square wave arriving at 118 and transmits the clock-frequency pulses arriving via AND gate 137. The pulses are applied through NAND gate 138 to the counting input of counter 129. However, count up is not authorized unless and until an enabling signal appears at input 117 and is transmitted to input D of flip-flop 126. Each time the memory is up-dated, counter 129 is first cleared by the Q output of monostable 125.

Counter 128 receives, via an AND gate 139, the 1000 Hz pulses from oscillator 37, starting from the leading edge of the 10 Hz signal from input 118 during the up-dating inhibition phases.

The up-dating inhibition signal is applied to input D of flip-flop 124 whereas the square waves arriving via 118 are applied to input H of the flip-flop whose output Q enables AND gate 139. Thus, counter 128 counts up until the moment when it is cleared to zero by applying a signal to the "clear" or RAZ input.

A comparator 140 compares the unit-weight bits (LSB) and a comparator 141 compares the tens-weight bits (MSB) contained in counters 129 and 128. The two comparators are connected in cascade. When the contents of 128 exceeds the contents of 129 by one unit, a signal appears at output 142. It is transmitted via gate 143 (which is enabled outside the initiating phase) to the "clear" inputs of flip-flop 124 and counter 128. When the flip-flop is cleared, a transition occurs at its Q output, is transferred to NAND gates 144 and 145 and ends a square wave having a length equal to the square wave stored in digital form in counter 129.

It will be appreciated that, during closed-loop operation, the square wave arriving at 118 is transferred to output 119 via gates 146 and 145 and the memory is simultaneously up-dated when up-dating is enabled by input 117, whereas during open-loop operation the stored value is transferred to output 119.

Incidentally, the use of a single oscillator 37 as a time base or clock for the entire system results in complete synchronization of all operations and eliminates the effects of any drift in the oscillator frequency, even during the period between stopping and restarting.

ADJUSTMENT AS A FUNCTION OF THE TEMPERATURE OF THE COOLING WATER: During open-loop operation, the cyclic aperture ratio imposed on solenoid valves $EV_1$ and $EV_2$ results from correction of the value stored in M by addition of a corrective term which depends on the temperature $\theta$.

To this end, the output 119 of the memory is connected to the input of a circuit 147 which also receives the output signal from CTN resistor 59. Circuit 147 may comprise a monostable flip-flop trigerred by the downward edge of the square wave from output 119, the duration of the square wave being dependent on the signal received from resistor 59. Thus, the square wave delivered by circuit 147 is longer than the incoming square wave by an amount which depends on the engine temperature.

During open-loop operation, switch 43 is in the position opposite to that shown in FIG. 10: the square waves delivered by circuit 147 are applied to unit 37*a* for controlling the solenoid valves $EV_1$ and $EV_2$.

PRE-SETTING OF THE SOLENOID VALVES: The regulation has to be relatively slow. This means that when closed-loop operation is resumed, the solenoid valve must already be actuated with an aperture ratio close to the ratio that will be impressed to them when steady conditions will have been reached. The main purpose of this feature is to avoid pollution from the exhaust.

To this end, the device in FIG. 10 comprises a presetting circuit. Starting from the memory output 119, the circuit comprises a square-wave stretching circuit 148 whose output is connected to the second fixed contact of switch 130. Circuit 148 can comprise a monostable whose set duration is adjustable via an input 149 and is used for stretching the output square wave of the memory by an adjustable amount which is usually a few milliseconds when the repetition frequency is 10 Hz.

During idling operation of the engine, the moving contacts of switch 130 are in the position shown in broken lines in FIG. 10, whereas under all other operating conditions they are in the continuous-line position. During idling, therefore, solenoid valves $EV_1$ and $EV_2$ are pre-set since they receive pulses whose cyclic ratio is represented by the stored value, plus a small percentage K fixed by circuit 148.

When closed-loop regulation is resumed at a low load, switch 130 returns to the position shown in continuous lines and switch 43 simultaneously closes the regulation loop. Due to pre-setting, the steady state operating value is rapidly reached during the transition to low load.

CONTROL OF THE IDLING SOLENOID VALVE OF THE SECOND BARREL: The idling valve in the second barrel is energized via the second moving contact of switch 130. It can be seen that during idling, the valve receives square waves having a time length determined by the adjusting circuit 147 in dependence on temperature, whereas at other open-loop operating conditions, the valve receives square waves from the stretching circuit 148.

The circuit in FIG. 10 further comprises other means for initiating operation, for forcibly charging capacitor 33 during open-loop operation. These circuits are comparable to those already shown in FIG. 3 and will not be described here, except to point out that they comprise a monostable 151 for the beginning of idling, an initiating circuit 152 which is energized when contact is made, and a circuit 94 for rapidly charging or discharging the capacitor 33, under the control of an overload detection comparator 74.

In some cases, it may be sufficient to use a simplified system which only temporarily stores the value of the cyclic aperture ratio of the valves from the instant when the loop opens. Referring to FIGS. 12 and 13, there is shown an embodiment of such a system.

The system shown in FIGS. 12 and 13 fulfills the following functions:

During normal operation, it constitutes a closed-loop system which controls solenoid valves located in the main and idling circuits, i.e. imposes a cyclic aperture ratio which maintains a stoichiometric fuel/air ratio;

Under full load, it constitutes an open-loop system which provides the enrichment necessary for maximum torque; and During acceleration when the engine is cold, it changes operation from closed-loop to open-loop and sets an initial cyclic aperture ratio of the solenoid valves which is in direct dependence on the cyclic ratio immediately before the loop is opened.

The various channels of the system are shown in the block diagram of FIG. 12 and will be described in succession.

The closed-loop regulating circuit 235 comprises an input probe, i.e. an oxygen probe (probe 223 in FIG. 13) in contact with the engine exhaust gases.

The output of circuit 235 is connected to a selection circuit 237, both directly and via an enrichment circuit 236 which is modulated during acceleration. A control input of circuit 237 receives a logic or binary signal at a first predetermined level (e.g. 1) if a temperature-threshold circuit 239 indicates that the engine temperature is below a given threshold and if a micro-switch 241 simultaneously closes, thus indicating that the engine accelerates. If only one or neither condition is fulfilled, circuit 237 receives a binary zero from a AND gate 238 whose inputs are connected to the outputs of circuits 239 and 242.

The signal appearing at the output of circuit 237 us amplified at 248, then applied to the main-circuit and idling-circuit solenoid valves, which are denoted $EV_1$ and $EV_2$ as in the preceding Figures.

A circuit 243 is used to open the loop when a microswitch 224 opens so as to indicate that the engine is operating under full load, which is indicated by a degree of vacuum downstream of the throttle valve which is lower than a predetermined threshold.

The various circuits shown in block form in FIG. 12 can be constructed as indicated in FIG. 13.

The analog output voltage from probe 223 is amplified at 245 and applied to the first input of a differential amplifier 246 whose other input receives a reference voltage. Switch 244 (FIGS. 12 and 13) which opens when the degree of vacuum downstream of the throttle valve is low, is provided for earthing the output of amplifier 245.

The output signal of amplifier 246, which consists of rectangular signals having a cyclic ratio depending on the oxygen content of the exhaust gases, is applied to the first input of a second differential amplifier 247 via the contact 248 (closed at rest) of a relay 249. The same input of amplifier 247 is also earthed via a storage capacitor 250, and is connected by a diode 251 to an intermediate point of a voltage-dividing resistance bridge.

The second input of amplifier 247 receives a sawtooth voltage from a circuit comprising an oscillator 272 (advantageously at a fixed frequency) and a trigerred ramp generator 273, which may be both of conventional type.

Circuit 236, which produces enrichment with respect to the value stored by capacitor 250, comprises a differential amplifier 252 whose two inputs are respectively connected by two different channels to the output of amplifier 247.

The first channel comprises a switching transistor 254 and a monostable 253 which amplifies a short pulse on receiving the trailing edge of each pulse from amplifier 247. As long as transistor 254 is blocked, a source of constant current 255 charges a capacitor 256. When transistor 254 is conducting, it earths capacitor 256.

The second channel comprises an inverter 257 and a switching transistor 258. When transistor 258 is blocked, a capacitor 259 is charged by a constant current supplied by a current generator 260, resulting in an increase in the voltage at the corresponding input of amplifier 252.

The selection circuit for applying the output of one or the other of the circuits to amplifier 248*a* comprises a second movable contact 262 of relay 249.

At rest (when the relay is de-energized), contact 262 is connected to the output of circuit 235 (FIG. 13). When relay 249 is energized, contact 262 connects the input of amplifier 248*a* to the output of circuit 236.

The winding of relay 249 is placed in a circuit which connects the battery to earth and comprises the contact 264 of a first relay, which is responsive to the engine cooling-water temperature and co-operates with a differential amplifier to form a circuit 239. It is in series with the contact 265 of the acceleration-detecting relay 242. The winding of relay 242 is energized when contact 241 closes. Referring to FIG. 12, there is shown a pneumatic motor for controlling the contact 241. The pneumatic motor comprises a casing 267 divided into two compartments by a diaphragm connected to contact 241. One compartment is connected to the carburettor induction passage whereas the other is connected to the first compartment by a restricted orifice 268. At rest, a return spring holds contact 241 open.

The system in FIGS. 12 and 13 operates as follows. During closed-loop operation (when the switches are in the positions shown in FIG. 13), the rectangular signals supplied by amplifier 246 are applied to the storage capacitor 250 which fulfills a memory function. Capacitor 250 discharges on to the output impedance of amplifier 246 when the latter is blocked. The differential amplifier 247 acts as a comparator and supplies a square wave as long as the saw-tooth voltage is lower than the voltage across capacitor 250.

As long as contact 262 is in its rest position, the square waves from the output of amplifier 247 are applied to solenoid valves $EV_1$ and $EV_2$ and keep them closed for short periods of time, at a rhythm which is determined by oscillator 272.

If the voltage peaks from probe 223 increase as a result of lack of oxygen, the voltage across capacitor 250 increases likewise and the time length of the output pulses from 247 increases, so that valves $EV_1$ and $EV_2$ are closed for longer periods.

On transition to full-load operation switch 224 closes and energizes the associated relay, whose contact 244 likewise closes and earths the input of amplifier 246. Amplifier 246 remains blocked and the voltage across capacitor 250 decreases to a value which is determined by diode 251 and the associated voltage-divider. The length of the pulses applied to the solenoid valves decreases to a value corresponding to the enrichment required for satisfactory full-load operation.

When the engine is cold, contact 264 is closed. If an acceleration occurs, contact 265 closes and remains closed until the pressures in the compartments of casing 267 are again balanced. Contacts 264 and 265 close simultaneously, thus opening contact 248 and switching contact 262.

As a result of the opening of contact 248, the voltage at the terminals of 250 will at least temporarily retain its last value before the contact opens. Consequently, square waves having a constant cyclic ratio appear at the output of amplifier 247. The positive square waves supplied by amplifier 247 are inverted at 257 and block transistor 258, so that capacitor 259 is charged at a constant current.

At the end of each positive square wave supplied by amplifier 247, there occur simultaneously:

A short pulse at the output of monostable 253, which makes 254 conductive and simultaneously resets to zero the voltage across capacitor 256, which is subsequently charged gradually at a constant current;

Conduction of transistor 258 thus instantaneously discharging 259 and keeping it discharged until a new square wave appears.

The values of the various components are selected so that the voltage of 259 increases more rapidly than the voltage at the terminals of 256. As soon as the voltages are equal, the output of amplifier 252 falls to zero.

Due to switching, of contact 262, the closure of solenoid valves $EV_1$ and $EV_2$ is controlled by the voltage square waves from amplifier 252.

The invention is not limited to the embodiments shown and described by way of example and it should be understood that the scope of the present patent extends to any modification within the ambit of the accompanying claims. It may be used to control the flow of fuel and/or air supplied to an engine, in a carburetion system as well as in a system where fuel is injected under pressure in the combustion chambers or intake pipe(s) of the engine.

I claim:

1. A fuel control system for an internal combustion engine having an exhaust conduit, comprising:

a probe in the exhaust conduit adapted to generate an electrical signal indicative of exhaust conditions, at least one circuit for supplying fuel and air to the engine, having solenoid valve means for metering at least the fuel flow rate in said circuit and opening into an air induction passage provided with an operator controlled throttle member downstream of the opening of said one circuit, a closed loop electronic control circuit connected to said probe and effective to control said solenoid valve means in dependence of said signal, and means for opening the loop responsive to predetermined operating conditions of the engine, said electronic circuit having further means for controlling said solenoid valve means in dependence on at least one engine operating parameter other than said exhaust conditions during open loop operation.

2. A fuel control system according to claim 1, wherein said further parameter is the temperature of the engine.

3. A fuel control system for an internal combustion engine having an exhaust conduit, comprising a probe in the exhaust conduit adapted to generate an electrical signal indicative of exhaust conditions, at least one circuit for supplying fuel and air to the engine, having solenoid valve means for metering at least the fuel flow rate in said circuit, a closed loop electronic control circuit connected to said probe and effective to control said solenoid valve means in dependence of said signal, and means for opening the loop responsive to predetermined operating conditions of the engine, said electronic circuit having means for providing a value representative of the average adjustment of the solenoid value means during closed-loop operation for a time period corresponding to several successive operating cycles of the engine, memory means connected to a voltage source for permanently storing said value when said engine is not operating and means for controlling the solenoid valve upon opening of said loop which adjusts said solenoid valve at a value which is in direct relation with the stored value modified in response to a signal from a sensor operating in response to an operating parameter of the engine.

4. A system according to claim 3, wherein the electronic circuit controls the solenoid valve by supplying periodic rectangular electric signals each for fully opening said valve means and whose aperture ratio determines the average time during which the solenoid valve is opened during a given time interval and determines the new adjustment responsive to loop opening by modifying the aperture from the stored value, in dependence on an engine operating parameter such as its temperature.

5. A system according to claim 3, wherein said memory means are volatile and are provided with separate electrical power supply means.

6. A system according to claim 1 or 3, wherein the electronic circuit operates under open loop conditions under at least one of the following conditions: when the engine temperature is below a first predetermined value; during acceleration and under full load when the engine temperature is between the first predetermined value and a second predetermined value, and under full load when the engine temperature is above the second predetermined value.

7. A system according to claim 1, further comprising means for determining the initial adjustment of said solenoid valve means when the loop is closed after an open-loop period of operation.

8. A system according to claim 7, further comprising means for storing a value representative of the actual adjustment of the solenoid valve means during open-loop operation and for providing it as initial value upon closure of said loop.

9. A system according to claim 1, 3 or 4, wherein the closed loop electronic circuit comprises means for adjusting the time constant of said circuit at a first or a second value and means for automatically selecting one or the other of said first and second values depending on the engine operating conditions.

10. A system according to claim 5 for a motor vehicle, wherein said separate supply means for the memory means comprises voltage regulating means having an input connected to a battery of the vehicle and providing a constant output voltage below the minimum possible value of the battery EMF during cold weather.

11. A system according to claim 1 or 3, having means for initial adjustment of the solenoid valve means at a predetermined value when the system is put into operation.

12. A system according to claim 4, wherein the memory means comprise a counter, means for supplying the counter with electrical pulses at a predetermined frequency, and counter-enabling means enabling the counter to count-up therein during each one of said rectangular electrical signals.

13. A system according to claim 12, further comprising means for preventing up-dating of the memory means during open-loop operation and under predetermined operating conditions of the engine.

14. A system according to claim 13, wherein up-dating is prevented during idling, under full load when the temperature of the engine cooling water is below a predetermined value and when the output signal of said probe indicates that the composition of the mixture supplied to the engine is none stoichiometric.

15. A system according to claim 1 or 3, wherein the probe is a λ probe, having an additional solenoid valve for supplying additional fuel to the engine, said additional valve being controlled by the probe and enriching the mixture supplied to the engine.

16. A system according to claim 14, wherein the additional solenoid valve is actuated by a circuit which has a response time less than the response time of the closed loop circuit actuating the first named solenoid valve means.

17. A system according to claim 1 or 3, comprising at least two flow-regulating solenoid valves controlling the flow rate of fuel entering a main idling circuit and an auxiliary circuit respectively, wherein one of the solenoid valves is controlled in closed loop mode and the other valve or valves is controlled in open loop mode when the engine runs idle.

18. A fuel control system for an internal combustion engine having an exhaust conduit, comprising:

a probe in the exhaust conduit adapted to generate an electrical signal indicative of exhaust conditions, at least one circuit for supplying fuel and air to the engine, having solenoid valve means for metering at least the fuel flow rate in said circuit, a closed loop electronic control circuit connected to said probe and effective to control said solenoid valve means in dependence of said signal, memory means for storing a value corresponding to a setting of said valve means during closed loop operation;

and means for opening the loop responsive to predetermined operating conditions of the engine, wherein, during open loop idling operation, the closed-loop electronic circuit presets the solenoid valve or an additional flow-regulating solenoid valve at a predetermined setting, which is related to the value contained in said memory means for storing an earlier adjustment of the valve.

19. A system according to claim 1 or 3, wherein the solenoid valve means are open when not energized, further comprising means for keeping the solenoid valves closed for a predetermined time after the electric supply has been cut off.

20. A system according to claim 4, further comprising means for detecting the presence of a short-circuit at the outlet of a control unit for the solenoid-valve means and means for preventing said rectangular electric signals from reaching the unit as long as a short-circuit is detected.

21. A system according to claim 1, 3 or 4, comprising carburetor means having an induction passage locating an operator controlled throttle valve, wherein said solenoid valve means comprises at least one solenoid valve on a fuel circuit opening into the induction passage at a venturi located in the induction passage upstream of the throttle valve and a solenoid valve located on an air path from atmosphere to a location in the induction passage downstream of the throttle valve.

22. A system according to claim 3, wherein said value is the average adjustment for a period of about 1 mn.

* * * * *